US011047261B2

(12) United States Patent
Terada et al.

(10) Patent No.: US 11,047,261 B2
(45) Date of Patent: Jun. 29, 2021

(54) STEAM TURBINE ASSEMBLING METHOD, STEAM TURBINE, AND UPPER HALF ASSEMBLY

(71) Applicant: MITSUBISHI HEAVY INDUSTRIES COMPRESSOR CORPORATION, Tokyo (JP)

(72) Inventors: Katsumi Terada, Hiroshima (JP); Hiroaki Irikawa, Hiroshima (JP); Yuichi Sasaki, Hiroshima (JP)

(73) Assignee: MITSUBISHI HEAVY INDUSTRIES COMPRESSOR CORPORATION, Tokyo (JP)

( * ) Notice: Subject to any disclaimer, the term of this patent is extended or adjusted under 35 U.S.C. 154(b) by 137 days.

(21) Appl. No.: 16/330,016

(22) PCT Filed: Sep. 5, 2016

(86) PCT No.: PCT/JP2016/075971
§ 371 (c)(1),
(2) Date: Mar. 1, 2019

(87) PCT Pub. No.: WO2018/042649
PCT Pub. Date: Mar. 8, 2018

(65) Prior Publication Data

US 2019/0186298 A1 Jun. 20, 2019

(51) Int. Cl.
*F01D 9/04* (2006.01)
*F01D 25/24* (2006.01)
(Continued)

(52) U.S. Cl.
CPC ..... *F01D 25/24* (2013.01); *F01D 9/04* (2013.01); *F01D 25/00* (2013.01); *F01D 25/246* (2013.01); *F01D 25/28* (2013.01)

(58) Field of Classification Search
CPC ..... F01D 25/24; F01D 25/246; F01D 25/00; F01D 25/28; F01D 9/04
See application file for complete search history.

(56) References Cited

U.S. PATENT DOCUMENTS 3,861,827 A * 1/1975 Peabody ..... F01D 25/246 415/209.2
8,276,273 B2 * 10/2012 Shigemoto ..... F02C 7/20 29/889.1

(Continued)

FOREIGN PATENT DOCUMENTS

JP S58-106103 A 6/1983
JP H02-087905 U 7/1990

OTHER PUBLICATIONS

International Search Report issued in corresponding International Patent Application No. PCT/JP2016/075971, dated Nov. 8, 2016 (4 pages).

(Continued)

*Primary Examiner* — Lawrence Averick
(74) *Attorney, Agent, or Firm* — Osha Bergman Watanabe & Burton LLP

(57) ABSTRACT

A steam turbine assembling method includes an upper half assembling step of, after disposing an upper half partition plate having an upper half partition plate division surface on the inner peripheral side of an upper half casing having an upper half casing division surface, attaching an upper half position defining portion to the upper half casing and the upper half partition plate so as to form an upper half assembly, and a lower half assembling step of disposing a lower half partition plate having a lower half partition plate division surface capable of abutting against the upper half partition plate division surface on an inner peripheral side of a lower half casing having a lower half casing division (Continued)

surface capable of abutting against the upper half casing division surface so as to form a lower half assembly.

10 Claims, 10 Drawing Sheets

(51) Int. Cl.
*F01D 25/00* (2006.01)
*F01D 25/28* (2006.01)

(56) References Cited

U.S. PATENT DOCUMENTS 8,668,450 B2 * 3/2014 Chevrette ..... F01D 25/24 415/211.2
9,162,329 B2 * 10/2015 Huber ..... F01D 25/285
9,528,393 B2 * 12/2016 Huber ..... F01D 25/28
9,739,177 B2 * 8/2017 Schaefer ..... F01D 25/246
2003/0057653 A1 * 3/2003 Popa ..... F16J 15/442 277/411
2006/0251514 A1 * 11/2006 Burdgick ..... F01D 25/246 415/214.1
2008/0271315 A1 * 11/2008 Nguyen ..... B23Q 9/005 29/889.2
2010/0083499 A1 * 4/2010 Shigemoto ..... F01D 25/26 29/889.1
2012/0171031 A1 * 7/2012 Chevrette ..... F01D 25/24 415/213.1
2013/0022453 A1 * 1/2013 Schaus ..... F01D 25/246 415/189
2013/0323026 A1 * 12/2013 Abbott ..... F01D 25/246 415/128
2014/0068911 A1 * 3/2014 Huber ..... B23P 15/04 29/426.1
2014/0072422 A1 * 3/2014 Huber ..... F01D 25/28 415/201
2014/0241876 A1 * 8/2014 Schaefer ..... F01D 25/246 415/213.1
2014/0250915 A1 * 9/2014 Swan ..... F01D 9/04 60/796
2016/0096249 A1 * 4/2016 Visajtaev ..... B24B 19/02 451/439

OTHER PUBLICATIONS

Written Opinion issued in corresponding International Patent Application No. PCT/JP2016/075971, dated Nov. 8, 2016 (9 pages).

* cited by examiner

STEAM TURBINE ASSEMBLING METHOD, STEAM TURBINE, AND UPPER HALF ASSEMBLY

TECHNICAL FIELD

The present invention relates to a steam turbine assembling method, a steam turbine, and an upper half assembly.

BACKGROUND OF THE INVENTION

A steam turbine includes: a rotor which rotates about an axis; and a casing which covers the rotor. The rotor includes a plurality of rotor blades which are disposed around a rotor shaft extending in an axial direction about the axis. A partition plate having a plurality of stator blades (nozzles) which are disposed around the rotor on an upstream side of the rotor blade is fixed to the casing. In the steam turbine, from the viewpoint of assembly or the like thereof, a cylindrical casing and an annular partition plate are divided into a plurality in a circumferential direction.

For example, Patent Document 1 discloses a steam turbine in which each of a partition plate and a casing is divided into an upper half and a lower half. In the steam turbine, a structure for regulating a vertical movement is provided in each of an upper half portion and a lower half portion. Specifically, a structure is provided, in which a partition plate support piece provided so as to protrude from an inner surface of the casing is inserted into a support groove formed on an outer peripheral surface of the support piece.

Meanwhile, in order to insert the partition plate support piece into the support groove, it is necessary to lift the partition plate so as to adjust the partition plate each time positioning adjustment between the casing and the partition plate is performed. Accordingly, as a structure configured to decrease the amount of adjustment needed, Patent Document 1 discloses a structure in which a slit-attached screw is screwed into a screw hole provided in a tangential direction at a boundary between the casing and the partition plate. In this structure, the position of the casing and the partition plate is completely fixed by the screw.

DOCUMENTS OF RELATED ART

Patent Documents

Patent Document 1: Japanese Unexamined Utility Model Application, First Publication No. H2-87905

SUMMARY OF THE INVENTION

Problems to be Solved by the Invention

However, in this way, if the position of the casing and the partition plate is completely fixed, it is difficult to absorb slight deviation generated when an upper half assembly which is the upper half portion and a lower half assembly which is the lower half portion are assembled together. As a result, there is a possibility that a gap is generated between the upper half assembly and the lower half assembly. Accordingly, it is desirable to suppress the occurrence of a gap between the upper half assembly and the lower half assembly while decreasing the amount of adjustment needed in positioning.

The present invention provides a steam turbine assembling method, a steam turbine, and an upper half assembly capable of suppressing the occurrence of the gap between the upper half assembly and the lower half assembly while decreasing the amount of adjustment needed in positioning.

Means to Solve the Problems

A steam turbine assembling method according to a first aspect of the present invention includes: an upper half casing preparation step in which an upper half casing is prepared, the upper half casing extending in a circumferential direction of a rotor rotatable about an axis and including upper half casing division surfaces on both ends thereof in the circumferential direction, the upper half casing division surfaces being horizontal surfaces facing downward in a vertical direction; a lower half casing preparation step in which a lower half casing is prepared, the lower half casing extending in the circumferential direction and including lower half casing division surfaces on both ends thereof in the circumferential direction, the lower half casing division surfaces being capable of abutting against the upper half casing division surfaces; an upper half partition plate preparation step in which an upper half partition plate is prepared, the upper half partition plate extending in the circumferential direction to be able to be disposed on an inner peripheral side of the upper half casing and including upper half partition plate division surfaces on both ends thereof in the circumferential direction, the upper half partition plate division surfaces being horizontal surfaces facing downward in the vertical direction; a lower half partition plate preparation step in which a lower half partition plate is prepared, the lower half partition plate extending in the circumferential direction to be able to be disposed on an inner peripheral side of the lower half casing and including lower half partition plate division surfaces on both ends thereof in the circumferential direction, the lower half partition plate division surfaces being capable of abutting against the upper half partition plate division surfaces; an upper half assembling step in which, after disposing the upper half partition plate on the inner peripheral side of the upper half casing, an upper half position defining portion, which causes the upper half casing and the upper half partition plate to be movable relative to each other such that the upper half partition plate division surfaces protrude with respect to the upper half casing division surfaces in the vertical direction, is attached to at least one of the upper half casing and the upper half partition plate to form an upper half assembly; a lower half assembling step in which the lower half partition plate is disposed on the inner peripheral side of the lower half casing to form a lower half assembly; and a final assembling step in which the upper half casing division surfaces are made to abut against the lower half casing division surfaces to install the upper half assembly on the lower half assembly.

According to this configuration, after the upper half partition plate is disposed on the inner peripheral side of the upper half casing, the upper half position defining portion is attached. Accordingly, the positions of the upper half casing division surface and the upper half partition plate division surface can be defined in a state where the upper half casing and the upper half partition plate are assembled together. In addition, when the lower half assembly and the upper half assembly are combined with each other, the upper half partition plate division surface further protrudes downward in the vertical direction than the upper half casing division surface due to its own weight of the upper half partition plate. Accordingly, when the upper half assembly is placed on the lower half assembly, the lower half partition plate division surface and the upper half partition plate division surface come into contact with each other at high accuracy.

Thereafter, the upper half partition plate moves relative to the upper half casing in the vertical direction in a state where the lower half partition plate division surface and the upper half partition plate division surface come into contact with each other. As a result, in a state where the upper half partition plate division surface and the lower half partition plate division surface come into contact with each other, the upper half casing division surface and the lower half casing division surface come into contact with each other, and the lower half assembly and the upper half assembly are combined with each other. Accordingly, by only placing the upper half assembly on the lower half assembly, the lower half partition plate division surface and the upper half partition plate division surface can come into contact with the lower half partition plate division surface and the upper half partition plate division surface at high accuracy.

In the steam turbine assembling method according to a second aspect of the present invention, the upper half casing preparation step according to the first aspect may include preparing the upper half casing having an upper half casing recessed portion recessed upward in the vertical direction on an inner peripheral side of the upper half casing division surface so as to form an upper half casing recess surface facing in a direction including the vertical direction, the upper half partition plate preparation step may include preparing the upper half casing having an upper half partition plate recessed portion which is recessed upward in the vertical direction on an outer peripheral side of the upper half partition plate division surface so as to form an upper half partition plate recess surface facing in the direction including the vertical direction and forms an accommodation space communicating with the upper half casing recessed portion when being disposed on the inner peripheral side of the upper half casing, the upper half assembling step may include: an upper half casing disposition step in which the upper half casing is disposed in a state where the upper half casing division surfaces face upward in the vertical direction; an upper half partition plate disposition step in which the upper half partition plate is disposed on the inner peripheral side of the upper half casing so as to form the accommodation space in a state where the upper half partition plate division surfaces face upward in the vertical direction; and an upper half vertical position defining step in which, after the upper half partition plate disposition step, an upper half abutment member having an upper half abutment surface capable of abutting against the upper half casing recess surface and the upper half partition plate recess surface is provided as the upper half position defining portion in the accommodation space to define positions of the upper half casing and the upper half partition plate in the vertical direction, wherein the upper half vertical position defining step may include fixing the upper half abutment member in a state where the upper half abutment surface abuts against at least one of the upper half casing recess surface and the upper half partition plate recess surface and in a state where the upper half abutment surface is movable in the vertical direction relative to the other of the upper half casing recess surface and the upper half partition plate recess surface.

According to this configuration, the upper half partition plate and the upper half casing are connected to each other to be movable via the upper half abutment member. Therefore, by the upper half abutment member, the upper half partition plate division surface can be made movable so as to protrude in the vertical direction with respect to the upper half casing division surface. In addition, the upper half abutment member can be disposed so as not to protrude from the upper half casing division surface and the upper half partition plate division surface. Accordingly, when the upper half assembly and the lower half assembly are combined with each other, it is possible to prevent the upper half abutment member from being disposed between the lower half partition plate division surface and the upper half partition plate division surface or at an interference position between the lower half partition plate division surface and the upper half partition plate division surface. In addition, the upper half abutment member can be attached to the upper half partition plate and the upper half casing from the upper portion in the vertical direction. Accordingly, when the upper half abutment member is fixed to the upper half partition plate or the upper half casing, it is unnecessary to perform a work so as to get the upper half abutment member in from the lower portion in the vertical direction with respect to the upper half partition plate and the upper half casing. As a result, the upper half abutment member is easily attached to the upper half partition plate and the upper half casing.

In the steam turbine assembling method according to a third aspect of the present invention, in the upper half casing preparation step according to the second aspect, the upper half casing recess surface may be formed to be parallel to the upper half casing division surface, and in the upper half partition plate preparation step, the upper half partition plate recess surface may be formed to be parallel to the upper half partition plate division surface.

According to this configuration, by only adjusting the positions of the parallel surfaces of the upper half casing recess surface and the upper half casing division surface in the vertical direction and the positions of the parallel surfaces of the upper half partition plate recess surface and the upper half partition plate division surface in the vertical direction, the positions of the upper half casing division surface and the upper half partition plate division surface are adjusted when the upper half abutment member is attached. Therefore, it is possible to easily perform delicate adjustment of a protrusion amount of the upper half partition plate division surface with respect to the upper half casing division surface.

In the steam turbine assembling method according to a fourth aspect of the present invention, the upper half vertical position defining step according to the second or third aspect may include causing the upper half abutment surface to abut against the upper half casing recess surface and the upper half partition plate recess surface to fix the upper half abutment member.

According to this configuration, when the upper half abutment member is attached, it is not necessary to finely adjust the position of the upper half abutment surface with respect to the upper half casing recess surface and the upper half partition plate recess surface. Therefore, it is possible to easily attach the upper half abutment member to the upper half partition plate and the upper half casing.

In the steam turbine assembling method according to a fifth aspect of the present invention, the lower half assembling step according to any one of the first to fourth aspects may include fixing a lower half abutment member having a lower half abutment surface which is a horizontal surface to at least one of the lower half casing and the lower half partition plate in a state where the lower half abutment surface abuts against the lower half casing division surface and the lower half partition plate division surface.

According to this configuration, the lower half casing division surface and the lower half partition plate division surface come into contact with the lower half abutment surface to be disposed on the same horizontal surface. In this state, the lower half abutment member is fixed to one of the lower half partition plate and the lower half casing, and thus, a state where the lower half casing division surface and the lower half partition plate division surface are disposed on the same horizontal surface is maintained. Accordingly, it is possible to define the positions of the lower half casing and the lower half partition plate in the vertical direction while decreasing the amount of adjustment needed in positioning of the lower half assembly.

A steam turbine according to a sixth aspect of the present invention includes: an upper half casing which extends in a circumferential direction of a rotor rotatable about an axis and includes upper half casing division surfaces, which are horizontal surfaces facing downward in a vertical direction, on both ends thereof in the circumferential direction; a lower half casing which extends in the circumferential direction and includes lower half casing division surfaces capable of abutting against the upper half casing division surfaces on both ends thereof in the circumferential direction; an upper half partition plate which extends in the circumferential direction to be able to be disposed on an inner peripheral side of the upper half casing and includes upper half partition plate division surfaces, which are horizontal surfaces facing downward in the vertical direction, on both ends thereof in the circumferential direction; a lower half partition plate which extends in the circumferential direction to be able to be disposed on an inner peripheral side of the lower half casing and includes lower half partition plate division surfaces on both ends thereof in the circumferential direction, the lower half partition plate division surfaces being capable of abutting against the upper half partition plate division surfaces; and an upper half position defining portion which defines positions of the upper half casing and the upper half partition plate in a state where the upper half casing and the upper half partition plate are movable relative to each other such that the upper half partition plate division surface protrude with respect to the upper half casing division surfaces in the vertical direction, in which the upper half casing includes an upper half casing recessed portion which is recessed upward in the vertical direction on an inner peripheral side of the upper half casing division surface so as to form an upper half casing recess surface facing in a direction including the vertical direction, the upper half partition plate includes an upper half partition plate recessed portion which is recessed upward in the vertical direction on an outer peripheral side of the upper half partition plate division surface so as to form an upper half partition plate recess surface facing in the direction including the vertical direction and forms an accommodation space communicating with the upper half casing recessed portion when being disposed on the inner peripheral side of the upper half casing, and the upper half position defining portion includes an upper half abutment member which is fixed to at least one of the upper half casing and the upper half partition plate in the accommodation space and has an upper half abutment surface formed to be able to abut against the upper half casing recess surface and the upper half partition plate recess surface.

In the steam turbine according to a seventh aspect of the present invention, in the sixth aspect, the steam turbine may further include a lower half abutment member having a lower half abutment surface which is a horizontal surface, and the lower half abutment member may be fixed to at least one of the lower half casing and the lower half partition plate in a state of abutting against the lower half casing division surface and the lower half partition plate division surface.

An upper half assembly according to an eighth aspect of the present invention includes: an upper half casing which extends in a circumferential direction of a rotor rotatable about an axis and includes upper half casing division surfaces, which are horizontal surfaces facing downward in a vertical direction, on both ends thereof in the circumferential direction; an upper half partition plate which extends in the circumferential direction to be disposed on an inner peripheral side of the upper half casing and includes upper half partition plate division surfaces, which are horizontal surfaces facing downward in the vertical direction, on both ends thereof in the circumferential direction; and an upper half position defining portion which defines a position of the upper half partition plate with respect to the upper half casing in a state where the upper half casing and the upper half partition plate are movable relative to each other such that the upper half partition plate division surfaces protrude with respect to the upper half casing division surfaces in the vertical direction, in which the upper half casing includes an upper half casing recessed portion which is recessed upward in the vertical direction on an inner peripheral side of the upper half casing division surface so as to form an upper half casing recess surface facing in a direction including the vertical direction, the upper half partition plate includes an upper half partition plate recessed portion which is recessed upward in the vertical direction on an outer peripheral side of the upper half partition plate division surface so as to form an upper half partition plate recess surface facing in the direction including the vertical direction and forms an accommodation space communicating with the upper half casing recessed portion when being disposed on the inner peripheral side of the upper half casing, and the upper half position defining portion includes an upper half abutment portion which is fixed to at least one of the upper half casing and the upper half partition plate in the accommodation space and has an upper half abutment surface formed to be able to abut against the upper half casing recess surface and the upper half partition plate recess surface.

Effects of the Invention

According to the present invention, it is possible to suppress the occurrence of a gap between the upper half assembly and the lower half assembly while decreasing the amount of adjustment needed in positioning.

EMBODIMENTS FOR CARRYING OUT THE INVENTION

First Embodiment

Hereinafter, a steam turbine according to an embodiment of the present invention will be described with reference to the drawings.

Figure 1:
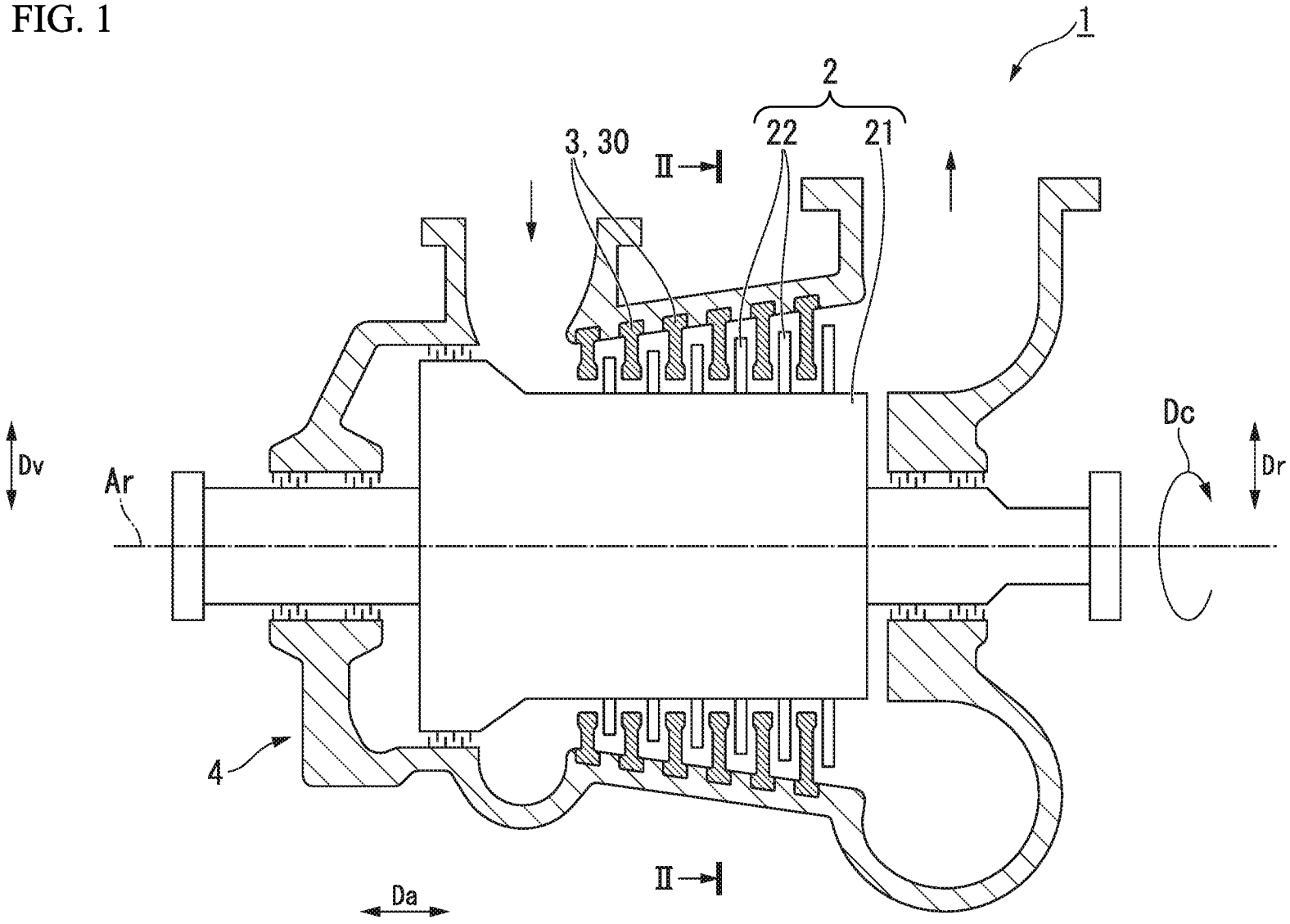
FIG. 1 is a sectional view of a steam turbine according to an embodiment of the present invention.
Figure 2:
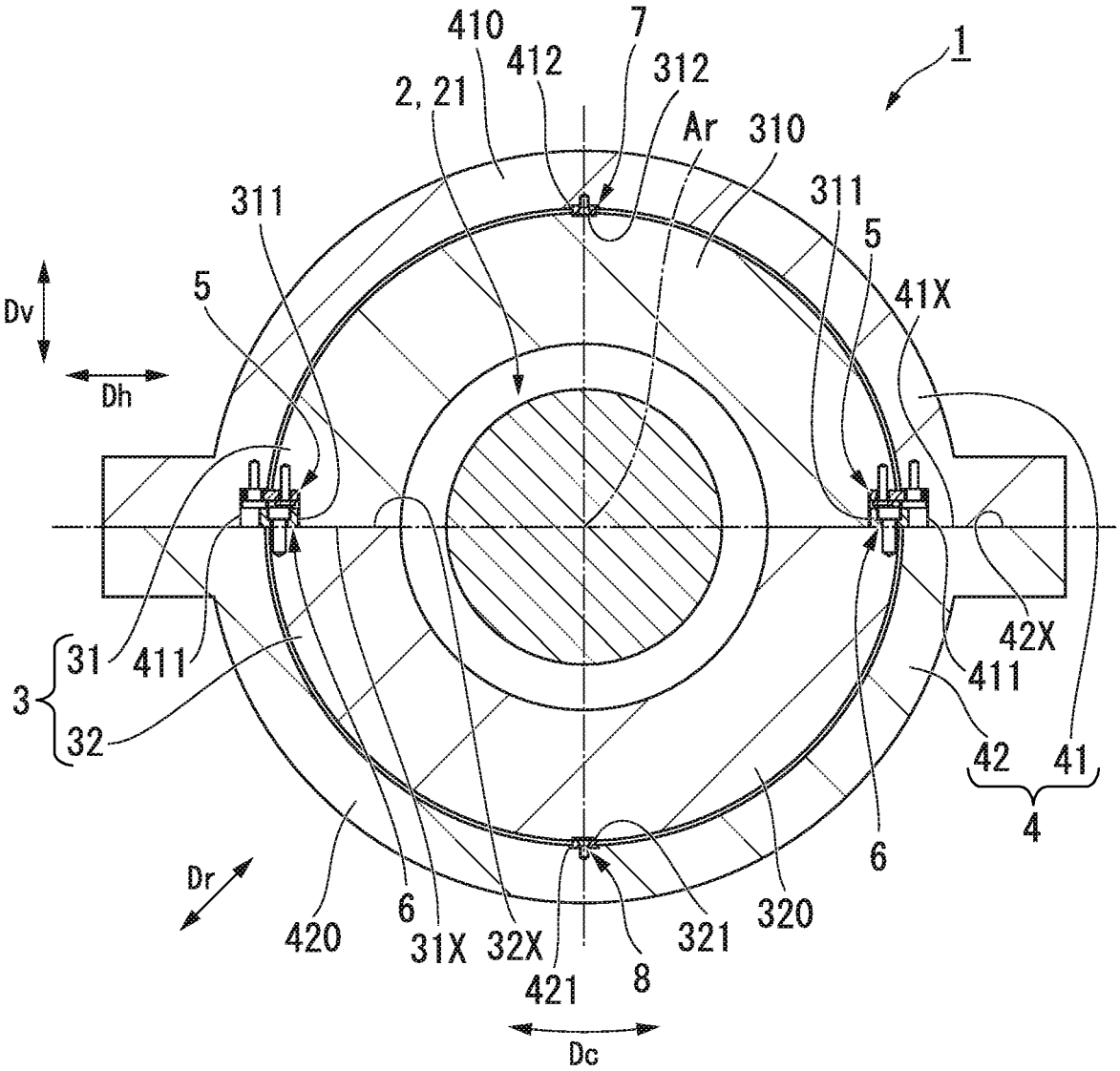
FIG. 2 is a sectional view taken along line II-II in FIG. 1.

As shown in FIGS. 1 and 2, a steam turbine 1 includes: a rotor 2; partition plates 3; a casing 4; upper half vertical position defining portions (upper half position defining portions) 5; lower half vertical position defining portions (lower half position defining portions) 6; an upper half horizontal position defining portion 7; and a lower half horizontal position defining portion 8.

The rotor 2 can rotate about an axis Ar. The rotor 2 includes: a rotor shaft 21 which extends in an axial direction Da about the axis Ar; and a plurality of rotor blades 22 which are fixed to the rotor shaft 21 to be aligned in a circumferential direction Dc with respect to the rotor shaft 21.

Moreover, hereinafter, a direction in which the axis Ar extends is referred to as the axial direction Da. A radial direction Dr based on the axis Ar is simply referred to as the radial direction Dr. In the radial direction Dr perpendicular to the axis Ar, an up direction on a paper surface of FIG. 2 is referred to as a vertical direction Dv. In addition, a right-left direction of FIG. 2 is referred to as a horizontal direction Dh. Moreover, a direction around the rotor 2 about the axis Ar is referred to as a circumferential direction Dc.

The partition plate 3 is disposed on an outer peripheral side of the rotor 2. The partition plate 3 is formed in an annular shape about the axis Ar. In the annular partition plate 3, a plurality of stator blades (nozzles) 30 aligned in the circumferential direction Dc are provided on an inner peripheral side of the partition plate 3 at a position on an upstream side of the rotor blade 22 of the rotor 2. In the steam turbine 1, a tubular space between an outer peripheral side of the rotor shaft 21 and an inner peripheral side of the annular partition plate 3, in other words, a space in which the rotor blades 22 and the stator blades 30 are disposed becomes a steam flow path. The annular partition plate 3 includes: an upper half partition plate 31 on an upper side based on the axis Ar of the rotor 2 in the vertical direction Dv; and a lower half partition plate 32 on a lower side based on the axis Ar of the rotor 2 in the vertical direction Dv. The upper half partition plate 31 and the lower half partition plate 32 will be described in detail later.

The casing 4 is disposed on the outer peripheral side of the partition plate 3. The casing 4 is formed in a tubular shape about the axis Ar. The tubular casing 4 includes: an upper half casing 41 on an upper side based on the axis Ar of the rotor 2; and a lower half casing 42 on a lower side based on the axis Ar of the rotor 2.

In the present embodiment, as shown in FIG. 2, the upper half casing 41 and the upper half partition plate 31 are combined with each other so as to constitute an upper half assembly 11. The lower half casing 42 and the lower half partition plate 32 are combined with each other so as to constitute a lower half assembly 12. The upper half assembly 11 is disposed with respect to the lower half assembly 12 such that the rotor 2 is interposed therebetween, and thus, the steam turbine 1 is formed.

The upper half casing 41 extends in the circumferential direction Dc. In the upper half casing 41 of the present embodiment, flanges extending in the horizontal direction Dh are formed on both ends thereof in the circumferential direction Dc. The upper half casing 41 has upper half casing division surfaces 41X on both ends thereof in the circumferential direction Dc. Each of the upper half casing division surfaces 41X is one division surface when the casing 4 is divided into upper and lower portions in the vertical direction Dv. Each upper half casing division surface 41X is a flat surface which spreads in the radial direction Dr and the axial direction Da. That is, the upper half casing division surface 41X is a horizontal surface facing downward in the vertical direction Dv. The upper half casing 41 of the present embodiment includes: an upper half casing body 410; upper half casing first recessed portions (upper half casing recessed portions) 411; and an upper half casing second recessed portion 412.

In the upper half casing body 410, a cross section orthogonal to the axis Ar is formed in a semicircular annular shape about the axis Ar. The upper half casing body 410 is open downward in the vertical direction Dv such that the rotor 2 and the partition plate 3 are fitted into the upper half casing body 410.

The upper half casing first recessed portions 411 are respectively formed symmetrically on the two upper half casing division surfaces 41X separated from each other in the horizontal direction Dh. Here, the upper half casing first recessed portion 411, which is positioned on one side in the horizontal direction Dh which is a right side in a paper surface in FIG. 2, is described as an example. In addition, the upper half casing first recessed portion 411 positioned on the other side in the horizontal direction Dh, which is not described, has the same shape.

Figure 3:
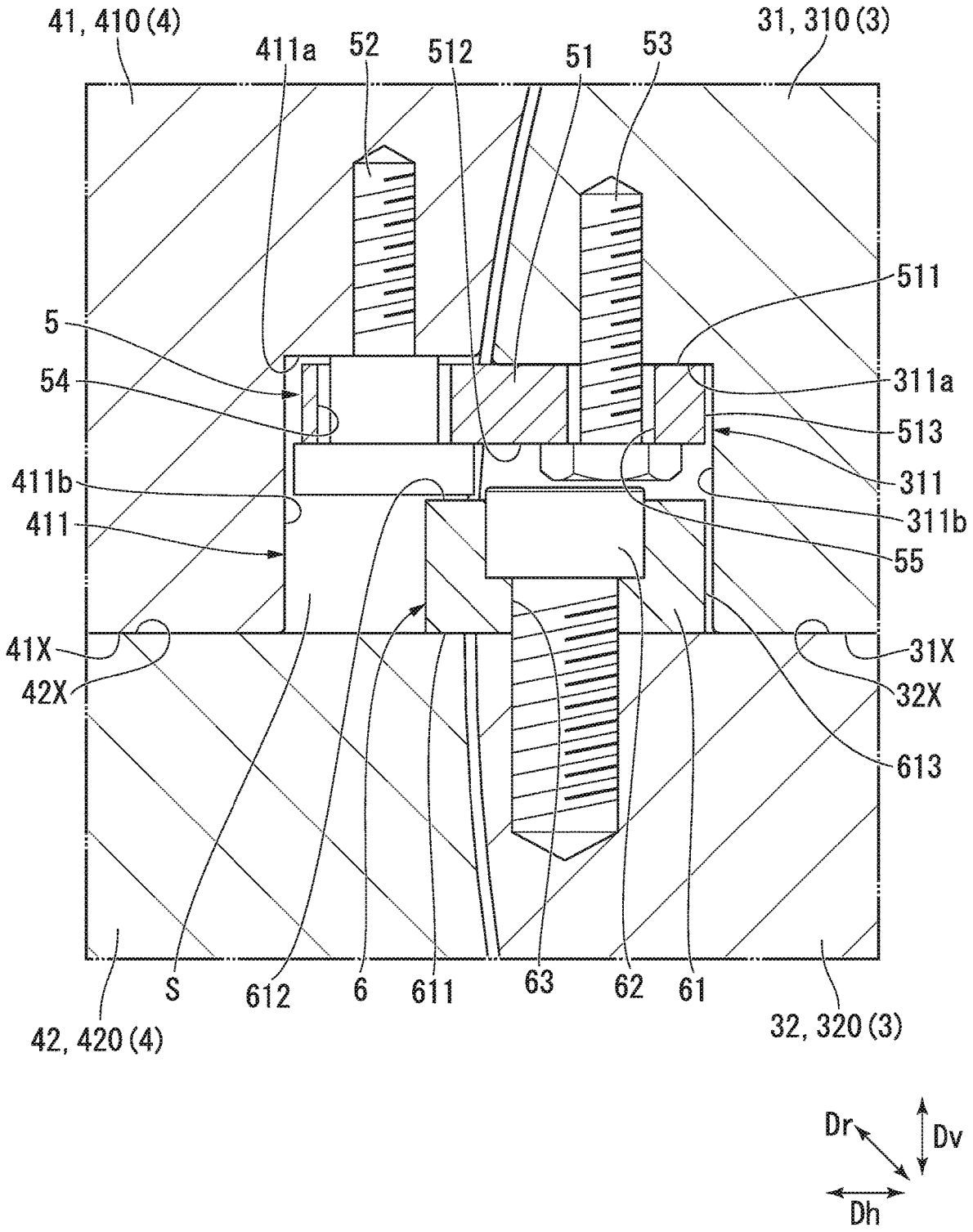
FIG. 3 is a main portion enlarged view showing an upper half vertical position defining member and a lower half vertical position defining member according to a first embodiment of the present invention.
Figure 4:
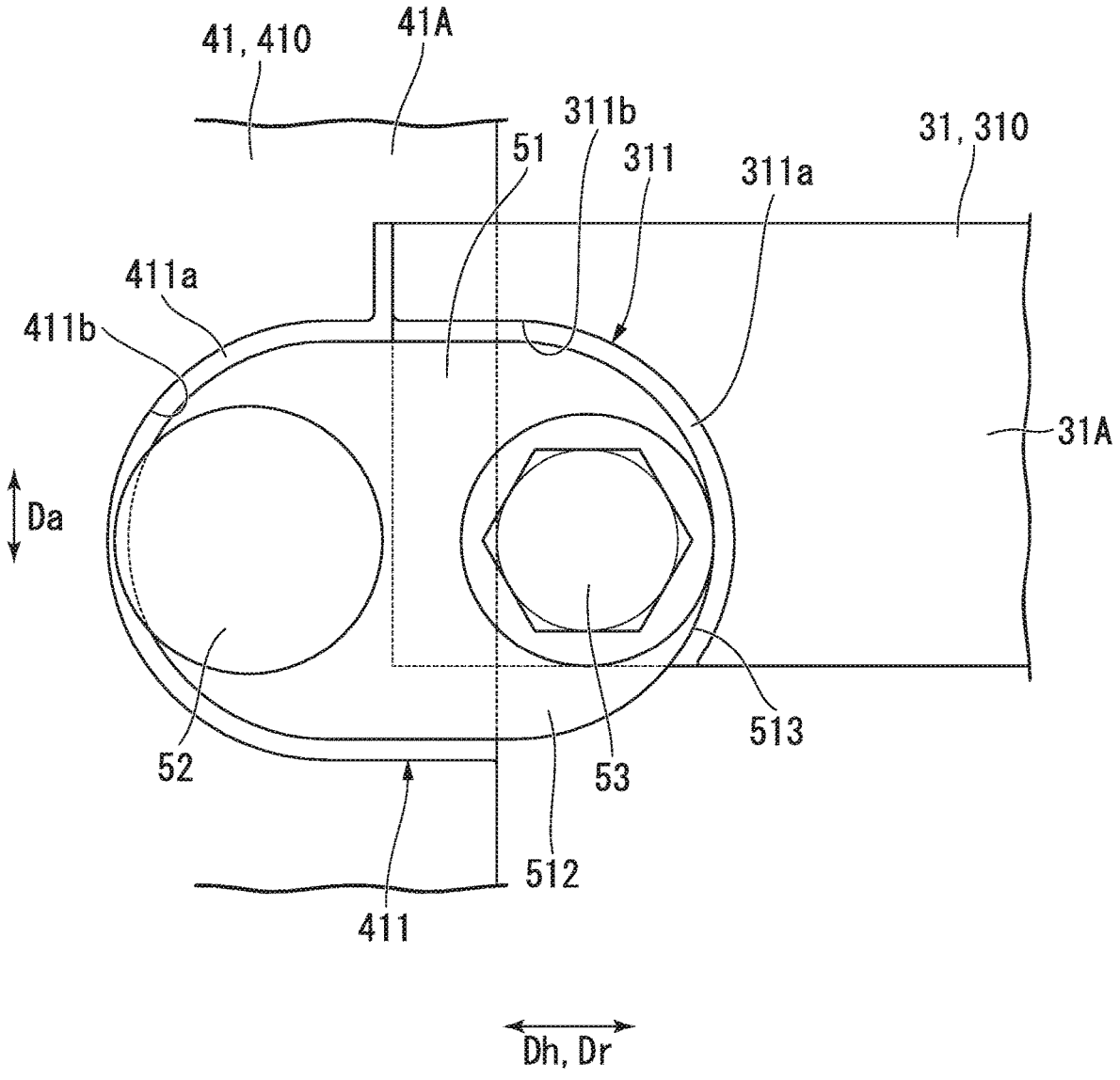
FIG. 4 is a main portion enlarged view showing the upper half vertical position defining member according to the first embodiment of the present invention in a vertical direction.

As shown in FIG. 3, the upper half casing first recessed portion 411 is recessed from the upper half casing division surface 41X. The upper half casing first recessed portion 411 is recessed upward in the vertical direction Dv on an inner peripheral side of the upper half casing division surface 41X. The upper half casing first recessed portion 411 is formed at a corner which is formed by an inner peripheral surface of the upper half casing body 410 and the upper half casing division surface 41X. As shown in FIG. 4, the upper half casing first recessed portion 411 is recessed from the inner peripheral surface of the upper half casing body 410 so as to form a semicircular shape when viewed from the upper half casing division surface 41X. As shown in FIG. 3, the upper half casing first recessed portion 411 includes: an upper half casing first flat surface (upper half casing recess surface) 411*a* facing in a direction including the vertical direction Dv; and an upper half casing first curved surface 411*b* facing the inside in the radial direction Dr.

The upper half casing first flat surface 411*a* is a surface which spreads in the radial direction Dr and the axial direction Da toward the upper half casing division surface 41X side so as to face in the direction including the vertical direction Dv. The upper half casing first flat surface 411*a* of the present embodiment is a horizontal surface facing downward in the vertical direction Dv. Accordingly, the upper half casing first flat surface 411*a* is formed to be parallel to the upper half casing division surface 41X. A bolt hole is formed in the upper half casing first flat surface 411*a*.

In addition, the upper half casing first flat surface 411*a* may be a flat surface facing in a direction inclined with respect to the vertical direction Dv as long as it is a surface facing in the direction including the vertical direction Dv.

The upper half casing first curved surface 411*b* is connected to the upper half casing division surface 41X and the upper half casing first flat surface 411*a*. The upper half casing first curved surface 411*b* spreads in a direction orthogonal to the upper half casing division surface 41X and the upper half casing first flat surface 411*a*. The upper half casing first curved surface 411*b* is a concave curved surface facing the inside in the radial direction Dr in a cross section orthogonal to the axis Ar. The upper half casing first curved surface 411*b* extends in the vertical direction Dv from the upper half casing division surface 41X.

Figure 5:
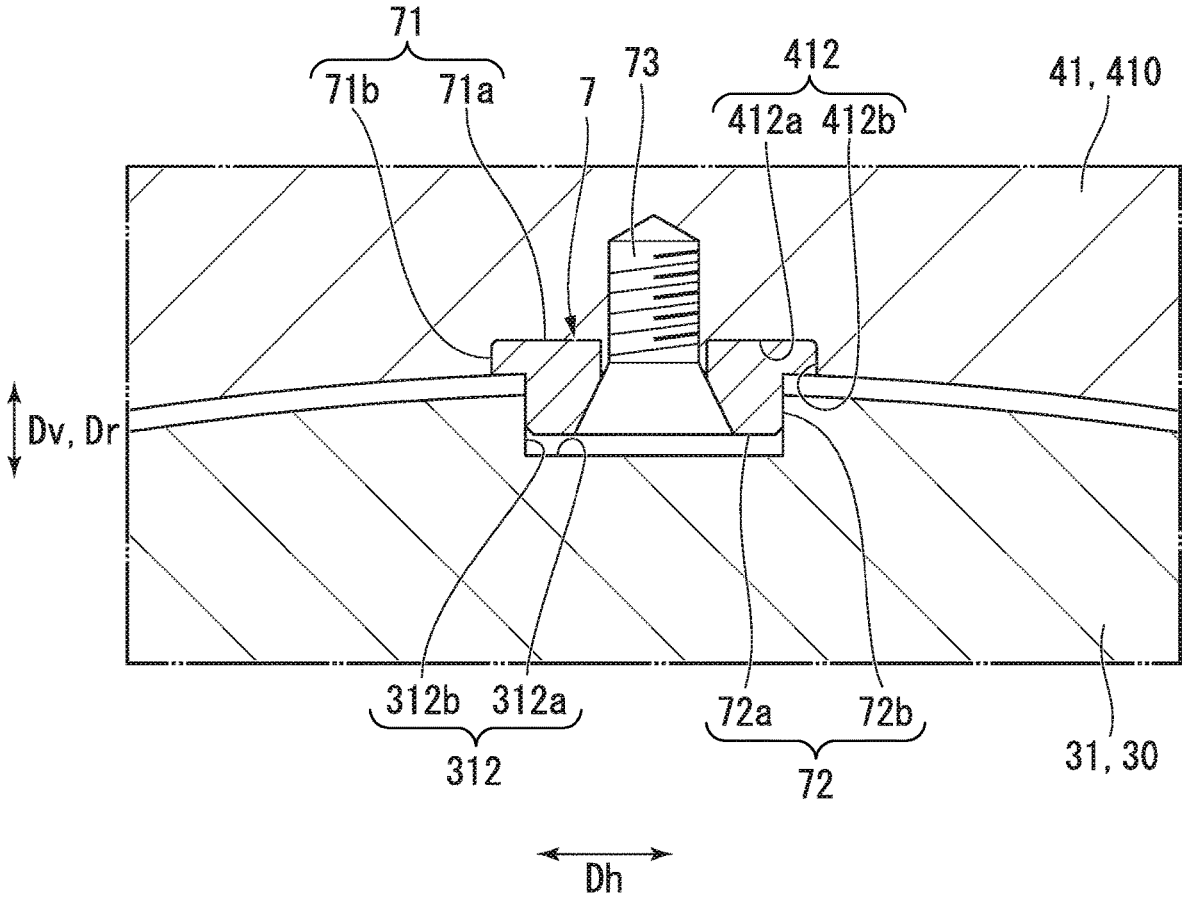
FIG. 5 is a main portion enlarged view showing an upper half horizontal position defining member according to the first embodiment of the present invention.

As shown in FIG. 2, the upper half casing second recessed portion 412 is formed on a top portion of the upper half casing body 410 in the vertical direction Dv. As shown in FIG. 5, the upper half casing second recessed portion 412 is recessed from the inner peripheral surface of the upper half casing body 410 toward the outside in the radial direction Dr. For example, the upper half casing second recessed portion 412 is recessed to be formed in a circular shape. The upper half casing second recessed portion 412 includes: an upper half casing second flat surface 412*a* facing the inside in the radial direction Dr; and an upper half casing second curved surface 412*b* which connects the inner peripheral surface of the upper half casing body 410 and the upper half casing second flat surface 412*a* to each other.

The upper half casing second flat surface 412*a* is a flat surface facing downward in the vertical direction Dv. The upper half casing second flat surface 412*a* is formed in a circular shape when viewed from the inside in the radial direction Dr. The upper half casing second curved surface 412*b* is a concave curved surface which extends in the vertical direction Dv from the inner peripheral surface of the upper half casing body 410.

As shown in FIG. 2, the lower half casing 42 extends in the circumferential direction Dc. In the lower half casing 42 of the present embodiment, flanges extending in the horizontal direction Dh are formed on both ends thereof in the circumferential direction Dc. The lower half casing 42 has lower half casing division surfaces 42X on both ends thereof in the circumferential direction Dc. Each of the lower half casing division surfaces 42X is the other division surface when the casing 4 is divided into upper and lower portions in the vertical direction Dv. Each lower half casing division surface 42X is a flat surface which spreads in the radial direction Dr and the axial direction Da. That is, the lower half casing division surface 42X is a horizontal surface facing upward in the vertical direction Dv. The lower half casing 42 of the present embodiment includes: a lower half casing body 420; and a lower half casing first recessed portion 421.

In the lower half casing body 420, a cross section orthogonal to the axis Ar is formed in a semicircular annular shape about the axis Ar. An inner diameter of the lower half casing body 420 is the same as an inner diameter of the upper half casing body 410. The lower half casing body 420 is open upward in the vertical direction Dv such that the rotor 2 and the partition plate 3 are fitted into the lower half casing body 420.

Figure 6:
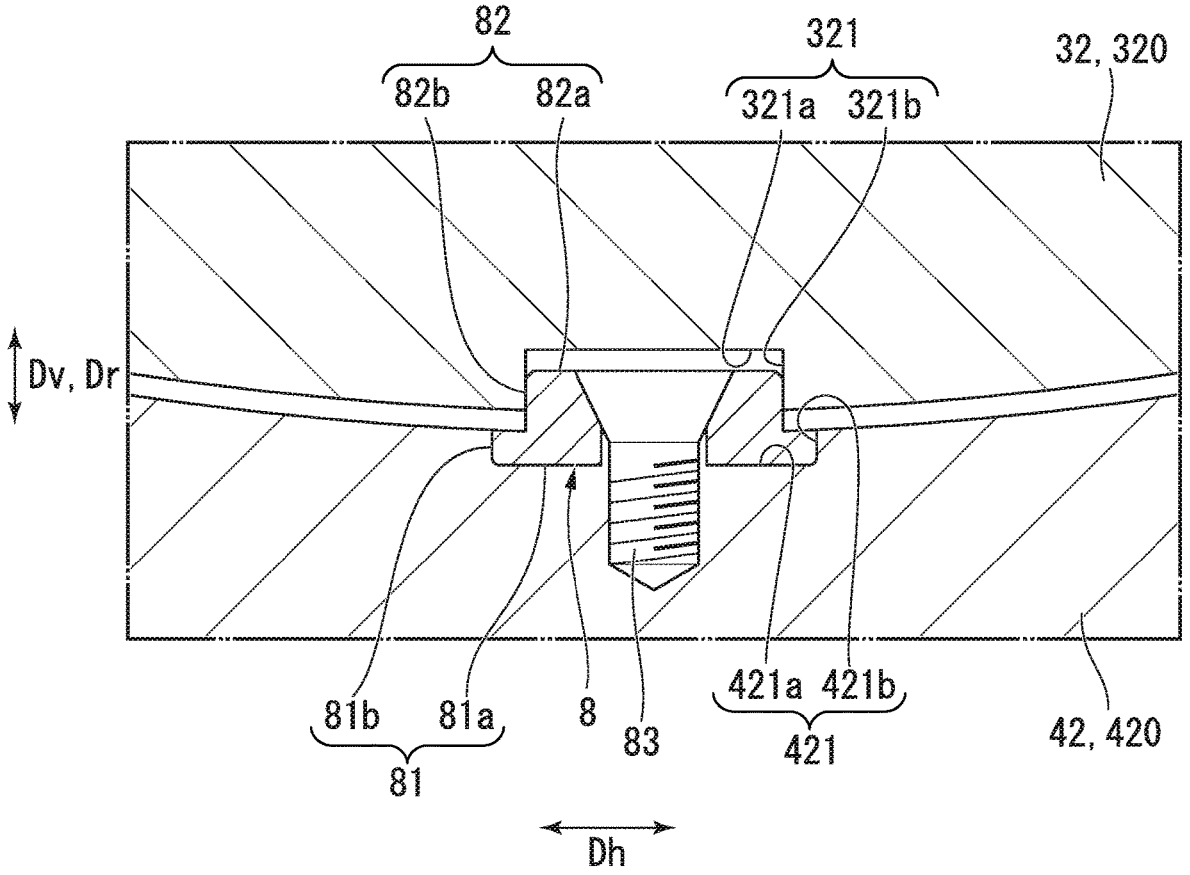
FIG. 6 is a main portion enlarged view showing a lower half horizontal position defining member according to the first embodiment of the present invention.

The lower half casing first recessed portion 421 is formed on a bottom portion of the upper half casing body 410 in the vertical direction Dv. As shown in FIG. 6, the lower half casing first recessed portion 421 is recessed from the inner peripheral surface of the lower half casing body 420 toward the outside in the radial direction Dr. For example, the lower half casing first recessed portion 421 is recessed to be formed in a circular shape. The lower half casing first recessed portion 421 has a shape symmetrical to the upper half casing second recessed portion 412 with a horizontal surface passing through the axis Ar as a boundary. The lower half casing first recessed portion 421 includes: a lower half casing first flat surface 421*a* facing the inside in the radial direction Dr; and a lower half casing first curved surface 421*b* which connects the inner peripheral surface of the lower half casing body 420 and the lower half casing first flat surface 421*a* to each other.

The lower half casing first flat surface 421*a* is a flat surface facing upward in the vertical direction Dv. The lower half casing first flat surface 421*a* is formed in a circular shape having the same diameter as that of the upper half casing second flat surface 412*a* when viewed from the inside in the radial direction Dr. The lower half casing first curved surface 421*b* is a concave curved surface which extends in the vertical direction Dv from the inner peripheral surface of the upper half casing body 410.

As shown in FIG. 2, the upper half partition plate 31 extends in the circumferential direction Dc. The upper half partition plate 31 can be disposed on an inner peripheral side of the upper half casing 41. The upper half partition plate 31 has upper half partition plate division surfaces 31X on both ends thereof in the circumferential direction Dc. The upper half partition plate division surface 31X is one division surface when the partition plate 3 is divided into upper and lower portions in the vertical direction Dv. The upper half partition plate division surface 31X is a flat surface which spreads in the radial direction Dr and the axial direction Da. That is, the upper half partition plate division surface 31X is a horizontal surface facing downward in the vertical direction Dv. The upper half partition plate 31 of the present embodiment includes: an upper half partition plate body 310; upper half partition plate first recessed portions (upper half partition plate recessed portions) 311; and an upper half partition plate second recessed portion 312.

In the upper half partition plate body 310, a cross section orthogonal to the axis Ar is formed in a semicircular annular shape about the axis Ar. The upper half partition plate body 310 can be accommodated in an opening portion of the upper half casing body 410 in a state where a slight gap is provided on the inner peripheral surface side of the upper half casing body 410. The upper half partition plate body 310 is formed such that an outer diameter thereof is slightly smaller than the inner diameter of the upper half casing body 410. The upper half partition plate body 310 is open downward in the vertical direction Dv such that the rotor 2 is fitted into the upper half partition plate body 310.

The upper half partition plate first recessed portions 311 are respectively formed symmetrically on the two upper half partition plate division surfaces 31X separated from each other in the horizontal direction Dh. Here, the upper half partition plate first recessed portion 311, which is positioned on one side in the horizontal direction Dh which is the right side in the paper surface in FIG. 2, is described as an example. In addition, the upper half partition plate first recessed portion 311 positioned on the other side in the horizontal direction Dh, which is not described, has the same shape.

As shown in FIG. 3, the upper half partition plate first recessed portion 311 is recessed from the upper half partition plate division surface 31X. The upper half partition plate first recessed portion 311 is recessed upward in the vertical direction Dv on an inner peripheral side of the upper half partition plate division surface 31X. The upper half partition plate first recessed portion 311 is formed at a corner which is formed by an outer peripheral surface of the upper half partition plate body 310 and the upper half partition plate division surface 31X. The upper half partition plate first recessed portion 311 forms an accommodation space S which communicates with the upper half casing first recessed portion 411 when the upper half partition plate 31 is disposed on the inner peripheral side of the upper half casing 41. Accordingly, the upper half partition plate first recessed portion 311 of the present embodiment is formed such that positions thereof in the circumferential direction Dc and the axial direction Da are the same as those of the upper half casing first recessed portion 411 in a state where the upper half partition plate 31 is disposed on the inner peripheral side of the upper half casing 41. As shown in FIG. 4, the upper half partition plate first recessed portion 311 is formed at a position closer to one side in the axial direction Da with respect to the upper half partition plate body 310. The upper half partition plate first recessed portion 311 is recessed from the upper half partition plate body 310 to be formed in a semicircular arc shape when viewed from the upper half partition plate division surface 31X side. As shown in FIG. 3, the upper half partition plate first recessed portion 311 includes: an upper half partition plate first flat surface (upper half partition plate recess surface) 311*a* facing in the direction including the vertical direction Dv; and an upper half partition plate first curved surface 311*b* facing the outside in the radial direction Dr.

In addition, the upper half partition plate first recessed portion 311 is not limited to being formed at the position closer to the one side in the axial direction Da with respect to the upper half partition plate body 310. For example, in a case where a thickness of the upper half partition plate body 310 in the axial direction Da is sufficiently secured, the upper half partition plate first recessed portion 311 may be formed at a center position in the axial direction Da with respect to the upper half partition plate body 310.

The upper half partition plate first flat surface 311*a* is a surface which spreads in the radial direction Dr and the axial direction Da toward the upper half partition plate division surface 31X side so as to face in the direction including the vertical direction Dv. The upper half partition plate first flat surface 311*a* of the present embodiment is a horizontal surface facing downward in the vertical direction Dv. Accordingly, the upper half partition plate first flat surface 311*a* is formed to be parallel to the upper half partition plate division surface 31X. The upper half partition plate first flat surface 311*a* is formed so as to be positioned on a side closer to the upper half partition plate division surface 31X than the upper half casing first flat surface 411*a* in a state where the upper half partition plate 31 is disposed on the inner peripheral side of the upper half casing 41 and the upper half partition plate division surface 31X and the upper half casing division surface 41X are disposed on the same surface as each other. That is, when the upper half assembly 11 and the lower half assembly 12 are assembled together, the upper half partition plate first flat surface 311*a* is positioned below the upper half casing first flat surface 411*a* in the vertical direction Dv. A bolt hole configured to fix the upper half vertical position defining portion 5 is formed on the upper half partition plate first flat surface 311*a*.

In addition, the upper half partition plate first flat surface 311*a* may be a flat surface facing in a direction inclined with respect to the vertical direction Dv as long as it is a surface facing in the direction including the vertical direction Dv.

The upper half partition plate first curved surface 311*b* is connected to the upper half partition plate division surface 31X and the upper half partition plate first flat surface 311*a*. The upper half partition plate first curved surface 311*b* spreads in a direction orthogonal to the upper half partition plate division surface 31X and the upper half partition plate first flat surface 311*a*. The upper half partition plate 31 casing 4 first curved surface is a concave curved surface facing the outside in the radial direction Dr in a cross section orthogonal to the axis Ar. The upper half partition plate first curved surface 311*b* extends in the vertical direction Dv from the upper half partition plate division surface 31X. A length of the upper half partition plate first curved surface 311*b* in the vertical direction Dv is shorter than a length of the upper half casing first curved surface 411*b* in the vertical direction Dv.

As shown in FIG. 2, the upper half partition plate second recessed portion 312 is formed on a top portion of the upper half partition plate body 310 in the vertical direction Dv. As shown in FIG. 5, the upper half partition plate second recessed portion 312 is recessed from an outer peripheral surface of the upper half partition plate body 310 toward the inside in the radial direction Dr. For example, the upper half partition plate second recessed portion 312 is recessed to be formed in a circular shape. The upper half partition plate second recessed portion 312 is formed such that positions thereof in the circumferential direction Dc and the axial direction Da are the same as those of the upper half casing second recessed portion 412 in a state where the upper half partition plate 31 is disposed on the inner peripheral side of the upper half casing 41. The upper half partition plate second recessed portion 312 includes: an upper half partition plate second flat surface 312*a* facing the outside in the radial direction Dr; and an upper half partition plate second curved surface 312*b* which connects the outer peripheral surface of the upper half partition plate body 310 and the upper half partition plate second flat surface 312*a* to each other.

The upper half partition plate second flat surface 312*a* is a flat surface facing upward in the vertical direction Dv. The upper half partition plate second flat surface 312*a* is formed in a circular shape having a diameter smaller than that of the upper half casing second flat surface 412*a* when viewed from the outside in the radial direction Dr. The upper half partition plate second flat surface 312*a* faces the upper half casing second flat surface 412*a* in a state where the upper half partition plate 31 is disposed on the inner peripheral side of the upper half casing 41. The upper half partition plate second curved surface 312*b* is a concave curved surface which extends in the vertical direction Dv from the outer peripheral surface of the upper half partition plate body 310.

As shown in FIG. 2, the lower half partition plate 32 extends in the circumferential direction Dc. The lower half partition plate 32 can be disposed on an inner peripheral side of the lower half casing 42. The lower half partition plate 32 has lower half partition plate division surfaces 32X on both ends thereof in the circumferential direction Dc. The lower half partition plate division surface 32X is the other division surface when the partition plate 3 is divided into upper and lower portions in the vertical direction Dv. The lower half partition plate division surface 32X is a flat surface which spreads in the radial direction Dr and the axial direction Da. That is, the lower half partition plate division surface 32X is a horizontal surface facing upward in the vertical direction Dv. The lower half partition plate 32 of the present embodiment includes: a lower half partition plate body 320; and a lower half partition plate first recessed portion 321.

In the lower half partition plate body 320, a cross section orthogonal to the axis Ar is formed in a semicircular annular shape about the axis Ar. The lower half partition plate body 320 can be accommodated in an opening portion of the lower half casing body 420 in a state where a slight gap is provided on the inner peripheral surface side of the lower half casing body 420. The lower half partition plate body 320 is formed such that an outer diameter thereof is slightly smaller than the inner diameter of the lower half casing body 420. The outer diameter of the lower half partition plate body 320 is the same as the outer diameter of the upper half partition plate body 310. The lower half partition plate body 320 is open upward in the vertical direction Dv such that the rotor 2 is fitted into the lower half partition plate body 320.

The lower half partition plate first recessed portion 321 is formed on a bottom portion of the lower half partition plate body 320 in the vertical direction Dv. As shown in FIG. 6, the lower half partition plate first recessed portion 321 is recessed from an outer peripheral surface of the lower half partition plate body 320 toward the inside in the radial direction Dr. For example, the lower half partition plate first recessed portion 321 is recessed to be formed in a circular shape. The lower half partition plate first recessed portion 321 is formed such that positions thereof in the circumferential direction Dc and the axial direction Da are the same as those of the lower half casing first recessed portion 421 in a state where the lower half partition plate 32 is disposed on the inner peripheral side of the lower half casing 42. The lower half partition plate first recessed portion 321 includes: a lower half partition plate second flat surface 322*a* facing the outside in the radial direction Dr; and a lower half partition plate 32 second curved surface which connects the inner peripheral surface of the lower half partition plate body 320 and the lower half partition plate second flat surface 322*a*. The lower half partition plate first recessed portion 321 has a shape symmetrical to the upper half partition plate second recessed portion 312 with a horizontal surface passing through the axis Ar as a boundary.

The lower half partition plate first flat surface 321*a* is a flat surface facing downward in the vertical direction Dv. The lower half partition plate first flat surface 321*a* is formed in a circular shape having a diameter smaller than that of the lower half casing first flat surface 421*a* when viewed from the outside in the radial direction Dr. The lower half partition plate first flat surface 321*a* faces the lower half casing first flat surface 421*a* in a state where the lower half partition plate 32 is disposed on the inner peripheral side of the lower half casing 42. The lower half partition plate first curved surface 321*b* is a concave curved surface which extends in the vertical direction Dv from the inner peripheral surface of the lower half partition plate body 320.

As shown in FIG. 2, the upper half vertical position defining portions 5 are respectively provided at two locations separated from each other in the horizontal direction Dh. Here, the upper half vertical position defining portion 5, which is positioned on one side in the horizontal direction Dh which is the right side in the paper surface in FIG. 2, is described as an example. In addition, the upper half vertical position defining portion 5 positioned on the other side in the horizontal direction Dh, which is not described, has the same configurations.

As shown in FIG. 3, the upper half vertical position defining portion 5 defines the positions of the upper half casing 41 and the upper half partition plate 31 in a state where the upper half partition plate division surface 31X is moveable relative to the upper half casing division surface 41X to protrude in the vertical direction Dv. The upper half vertical position defining portion 5 regulates a relative movement between the upper half casing 41 and the upper half partition plate 31 in a direction orthogonal to the upper half casing division surface 41X and the upper half partition plate division surface 31X. That is, the upper half vertical position defining portion 5 regulates a relative movement between the upper half casing 41 and the upper half partition plate 31 in the vertical direction Dv. The upper half vertical position defining portion 5 of the present embodiment regulates the position of the upper half casing 41 with respect to the upper half partition plate 31 in the vertical direction Dv. Accordingly, the upper half vertical position defining portion 5 causes the upper half casing 41 and the upper half partition plate 31 to be movable relative to each other between a position at which the upper half partition plate division surface 31X protrudes in the vertical direction Dv with respect to the upper half casing division surface 41X and a position at which the upper half partition plate division surface 31X does not protrude in the vertical direction Dv with respect to the upper half casing division surface 41X (a position at which the upper half casing division surface 41X protrudes in the vertical direction Dv with respect to the upper half partition plate division surface 31X). Each upper half vertical position defining portion 5 is accommodated in the accommodation space S. The upper half vertical position defining portion 5 includes: an upper half abutment member 51; an upper half first fixing member 52; and an upper half second fixing member 53.

The upper half abutment member 51 is fixed to at least one of the upper half casing 41 and the upper half partition plate 31 in the accommodation space S. The upper half abutment member 51 of the present embodiment is attached to both of the upper half casing 41 and the upper half partition plate 31. The upper half abutment member 51 regulates the relative movement of the upper half casing first flat surface 411*a* with respect to the upper half partition plate first flat surface 311*a* in the vertical direction Dv. The upper half abutment member 51 of the present embodiment regulates the position of the upper half casing first flat surface 411*a* with respect to the upper half partition plate first flat surface 311*a* such that the upper half casing first flat surface 411*a* is not closer to the upper half partition plate division surface 31X side than the upper half partition plate first flat surface 311*a*. Specifically, the upper half abutment member 51 causes the upper half casing first flat surface 411*a* does not further protrude toward the upper half partition plate division surface 31X side than the upper half partition plate first flat surface 311*a*. The upper half abutment member 51 of the present embodiment is a block-shaped member which is formed to have a size which can be accommodated in the accommodation space S. The upper half abutment member 51 includes: an upper half abutment surface 511 which faces the upper half casing first flat surface 411*a* and the upper half partition plate first flat surface 311*a*; an upper half separation surface 512 which is separated from the upper half abutment surface 511 and faces a side opposite to the upper half abutment surface 511; an upper half connection side surface 513 which connects the upper half abutment surface 511 and the upper half separation surface 512; an upper half abutment member first through-hole 54 which penetrates from the upper half abutment surface 511 to the upper half separation surface 512; and an upper half abutment member second through-hole 55 which penetrates from the upper half abutment surface 511 to the upper half separation surface 512 at a position different from that of the upper half abutment member first through-hole 54.

The upper half abutment surface 511 can abut against the upper half casing first flat surface 411*a* and the upper half partition plate first flat surface 311*a*. The upper half abutment surface 511 of the present embodiment is a flat surface which is parallel to the upper half casing first flat surface 411*a* and the upper half partition plate first flat surface 311*a*. The upper half abutment surface 511 is formed in an elliptical shape. In a state where the upper half assembly 11 is installed on the lower half assembly 12, the upper half abutment surface 511 is formed at a position at which the upper half abutment surface 511 comes into contact with only the upper half partition plate first flat surface 311*a* and a gap is formed between the upper half abutment surface 511 and the upper half casing first flat surface 411*a*.

The upper half separation surface 512 is a flat surface which is parallel to the upper half abutment surface 511. The upper half separation surface 512 is formed in the same shape as that of the upper half abutment surface 511. That is, the upper half separation surface 512 is formed in an elliptical shape. The upper half separation surface 512 is formed to be closer to the upper half partition plate first flat surface 311*a* side and the upper half casing first flat surface 411*a* side than the upper half partition plate division surface 31X and the upper half casing division surface 41X in a state where the upper half abutment member 51 is disposed in the accommodation space S.

The upper half connection side surface 513 is a side surface which is orthogonal to the upper half abutment surface 511 and the upper half separation surface 512. The upper half connection side surface 513 is formed at a position at which a gap is formed between the upper half partition plate first curved surface 311*b* and the upper half casing first curved surface 411*b* in the state where the upper half abutment member 51 is disposed in the accommodation space S.

The upper half first fixing member 52 fixes the upper half abutment member 51 to the upper half casing 41. The upper half first fixing member 52 is a pin member which is fixed to a bolt hole formed on the upper half casing first flat surface 411*a* in a state of being inserted into the upper half abutment member first through-hole 54. The upper half first fixing member 52 fixes the upper half abutment member 51 in a state of being movable with respect to the upper half casing first flat surface 411*a*.

The upper half second fixing member 53 fixes the upper half abutment member 51 to the upper half partition plate 31. The upper half first fixing member 52 is a bolt which is fixed to a bolt hole formed on the upper half partition plate first flat surface 311*a* in a state of being inserted into the upper half abutment member second through-hole 55. The upper half second fixing member 53 fixes the upper half abutment member 51 in a state of being unmovable while being in contact with the upper half partition plate first flat surface 311*a*.

As shown in FIG. 2, the lower half vertical position defining portions 6 are respectively provided at two locations which are separated from each other in the horizontal direction Dh so as to correspond to the upper half vertical position defining portions 5. Here, the lower half vertical position defining portion 6, which is positioned on one side in the horizontal direction Dh which is the right side in the paper surface in FIG. 2, is described as an example. In addition, the lower half vertical position defining portion 6 positioned on the other side in the horizontal direction Dh, which is not described, has the same configurations.

The lower half vertical position defining portion 6 regulates a relative movement between the lower half casing 42 and the lower half partition plate 32 in a direction orthogonal to the lower half casing division surface 42X and the lower half partition plate division surface 32X. The lower half vertical position defining portion 6 of the present embodiment defines the position of the lower half partition plate 32 with respect to the lower half casing 42 such that the lower half casing division surface 42X and the lower half partition plate division surface 32X are positioned on the same horizontal surface. The lower half vertical position defining portion 6 of the present embodiment is provided at a position at which the lower half vertical position defining portion 6 is disposed in the accommodation space S in the state where the upper half assembly 11 is installed on the lower half assembly 12. The lower half vertical position defining portion 6 is formed at a position at which positions thereof in the horizontal direction Dh and the axial direction Da overlap positions of the upper half vertical position defining portion 5 in the horizontal direction Dh and the axial direction Da. The lower half vertical position defining portion 6 includes: a lower half abutment member 61; and a lower half first fixing member 62.

The lower half abutment member 61 is fixed to at least one of the lower half casing 42 and the lower half partition plate 32. The lower half abutment member 61 of the present embodiment is fixed to only the lower half partition plate 32. The lower half abutment member 61 is disposed on the same horizontal surface as those of the lower half casing division surface 42X and the lower half partition plate division surface 32X. Accordingly, the lower half abutment member 61 defines the position of the lower half casing division surface 42X with respect to the lower half partition plate division surface 32X in the vertical direction Dv such that the lower half casing division surface 42X is always positioned on the same horizontal surface as that of the lower half partition plate division surface 32X. The lower half abutment member 61 of the present embodiment is a block-shaped member which is formed to have a size which can be accommodated in the accommodation space S together with the upper half abutment member 51. The lower half abutment member 61 includes: a lower half abutment surface 611 which faces the lower half casing division surface 42X and the lower half partition plate division surface 32X; a lower half separation surface 612 which is separated from the lower half abutment surface 611 and faces a side opposite to the lower half abutment surface 611; a lower half connection side surface 613 which connects the lower half abutment surface 611 and the lower half separation surface 612 to each other; and a lower half abutment member first through-hole 63 which penetrates from the lower half abutment surface 611 to the lower half separation surface 612.

The lower half abutment surface 611 can abut against the lower half casing division surface 42X and the lower half partition plate division surface 32X. The lower half abutment surface 611 of the present embodiment is a flat surface which is parallel to the lower half casing first flat surface 421*a* and the lower half partition plate first flat surface 321*a*. The lower half abutment surface 611 is formed in a circular shape. The lower half abutment surface 611 abuts against both the lower half casing division surface 42X and the lower half partition plate division surface 32X.

The lower half separation surface 612 is a flat surface which is parallel to the lower half abutment surface 611. The lower half separation surface 612 is formed in the same shape as that of the lower half abutment surface 611. That is, the lower half separation surface 612 is formed in a circular shape. The lower half separation surface 612 is disposed to be closer to the upper half partition plate first flat surface 311*a* and the upper half casing first flat surface 411*a* than the lower half partition plate division surface 32X and the lower half casing division surface 42X in a state where the lower half abutment member 61 is disposed in the accommodation space S. The lower half separation surface 612 is formed at a position at which the lower half separation surface 612 does not interfere with the upper half abutment member 51 in the vertical direction Dv in a state where the lower half abutment member 61 is disposed in the accommodation space S.

The lower half connection side surface 613 is a side surface which is orthogonal to the lower half abutment surface 611 and the lower half separation surface 612. The lower half connection side surface 613 is formed at a position at which a gap is formed between the upper half partition plate first curved surface 311*b* and the upper half casing first curved surface 411*b* in a state where the lower half abutment member 61 is disposed in the accommodation space S.

The lower half first fixing member 62 fixes the lower half abutment member 61 to the lower half partition plate 32. The lower half first fixing member 62 is a bolt which is fixed to a bolt hole formed on the lower half casing first flat surface 421*a* in a state of being inserted into the lower half abutment member first through-hole 63. The lower half first fixing member 62 fixes the lower half abutment member 61 in a state of being unmovable while being in contact with the lower half partition plate first flat surface 321*a*.

As shown in FIG. 2, the upper half horizontal position defining portion 7 is formed on top portions of the upper half casing body 410 and the upper half partition plate body 310 in the vertical direction Dv. The upper half horizontal position defining portion 7 defines a position of the upper half partition plate 31 with respect to the upper half casing 41 in the horizontal direction Dh. Accordingly, the upper half horizontal position defining portion 7 regulates a relative movement between the upper half casing 41 and the upper half partition plate 31 in a direction parallel to the upper half casing division surface 41X and the upper half partition plate division surface 31X. As shown in FIG. 5, the upper half horizontal position defining portion 7 of the present embodiment is provided in the upper half casing second recessed portion 412 and the upper half partition plate second recessed portion 312. The upper half horizontal position defining portion 7 includes: an upper half horizontal first abutment portion 71 which is inserted into the upper half casing second recessed portion 412; an upper half horizontal second abutment portion 72 which is inserted into the upper half partition plate second recessed portion 312; and an upper half horizontal fixing member 73 which fixes the upper half horizontal first abutment portion 71 and the upper half horizontal second abutment portion 72.

The upper half horizontal first abutment portion 71 is fitted into the upper half casing second recessed portion 412. The upper half horizontal first abutment portion 71 is formed in a disk shape corresponding to the upper half casing second recessed portion 412. The upper half horizontal first abutment portion 71 includes: an upper half horizontal first abutment flat surface 71*a* which faces the upper half casing second flat surface 412*a*; and an upper half horizontal first abutment curved surface 71*b* which faces the upper half casing second curved surface 412*b*.

The upper half horizontal first abutment flat surface 71*a* is a flat surface which abuts against the upper half casing second flat surface 412*a*. The upper half horizontal first abutment flat surface 71*a* is formed in a circular shape having the same diameter as that of the upper half casing second flat surface 412*a* when viewed in the radial direction Dr. The upper half horizontal first abutment curved surface 71*b* is a concave curved surface which abuts against the upper half casing second curved surface 412*b*.

The upper half horizontal second abutment portion 72 is formed in a disk shape corresponding to the upper half partition plate second recessed portion 312. The upper half horizontal second abutment portion 72 is formed in a disk shape having a diameter smaller than that of the upper half horizontal first abutment portion 71. The upper half horizontal second abutment portion 72 includes: an upper half horizontal second abutment flat surface 72*a* which faces the upper half partition plate second flat surface 312*a*; and an upper half horizontal second abutment curved surface 72*b* which faces the upper half partition plate second curved surface 312*b*.

The upper half horizontal second abutment flat surface 72*a* is a flat surface which is separated from the upper half partition plate second flat surface 312*a* and faces the upper half partition plate second flat surface 312*a*. The upper half horizontal second abutment flat surface 72*a* is formed in a circular shape having the same diameter as that of the upper half partition plate second flat surface 312*a* when viewed in the radial direction Dr. The upper half horizontal second abutment curved surface 72*b* is a concave curved surface which abuts against the upper half partition plate second curved surface 312*b*.

The upper half horizontal fixing member 73 fixes the upper half horizontal first abutment portion 71 and the upper half horizontal second abutment portion 72 to the upper half casing 41. The upper half horizontal fixing member 73 is a bolt which is fixed to a bolt hole formed on the upper half partition plate second flat surface 312*a* in a state of penetrating the upper half horizontal first abutment portion 71 and the upper half horizontal second abutment portion 72. The upper half horizontal fixing member 73 fixes the upper half horizontal first abutment portion 71 and the upper half horizontal second abutment portion 72 in a state where the upper half horizontal first abutment flat surface 71*a* is unmovable while being in contact with the upper half partition plate second flat surface 312*a*.

As shown in FIG. 2, the lower half horizontal position defining portion 8 is formed on bottom portions of the lower half casing body 420 and the lower half partition plate body 320 in the vertical direction Dv. The lower half horizontal position defining portion 8 defines a position of the lower half partition plate 32 with respect to the lower half casing 42 in the horizontal direction Dh. Accordingly, the lower half horizontal position defining portion 8 regulates a relative movement between the lower half casing 42 and the lower half partition plate 32 in a direction parallel to the lower half casing division surface 42X and the lower half partition plate division surface 32X. As shown in FIG. 6, the lower half horizontal position defining portion 8 of the present embodiment is provided in the lower half casing first recessed portion 421 and the lower half partition plate first recessed portion 321. The lower half horizontal position defining portion 8 is formed in the same shape as that of the upper half horizontal position defining portion 7. The lower half horizontal position defining portion 8 includes: a lower half horizontal first abutment portion 81 which is inserted into the lower half casing first recessed portion 421; a lower half horizontal second abutment portion 82 which is inserted into the lower half partition plate first recessed portion 321; and a lower half horizontal fixing member 83 which fixes the lower half horizontal first abutment portion 81 and the lower half horizontal second abutment portion 82.

The lower half horizontal first abutment portion 81 is fitted into the lower half casing first recessed portion 421. The lower half horizontal first abutment portion 81 is formed in a disk shape corresponding to the lower half casing first recessed portion 421. The lower half horizontal first abutment portion 81 includes: a lower half horizontal first abutment flat surface 81*a* which faces the lower half casing first flat surface 421*a*; and a lower half horizontal first abutment curved surface 81*b* which faces the lower half casing first curved surface 421*b*.

The lower half horizontal first abutment flat surface 81*a* is a flat surface which abuts against the lower half casing first flat surface 421*a*. The lower half horizontal first abutment flat surface 81*a* is formed in a circular shape having the same diameter as that of the lower half casing first flat surface 421*a* when viewed from the inside in the radial direction Dr. The lower half horizontal first abutment curved surface 81*b* is a concave curved surface which abuts against the lower half casing first curved surface 421*b*.

The lower half horizontal second abutment portion 82 is formed in a disk shape corresponding to the lower half partition plate first recessed portion 321. The lower half horizontal second abutment portion 82 is formed in a disk shape having a diameter smaller than that of the lower half horizontal first abutment portion 81. The lower half horizontal second abutment portion 82 includes: a lower half horizontal second abutment flat surface 82*a* which faces the lower half partition plate first flat surface 321*a*; and a lower half horizontal second abutment curved surface 82*b* which faces the lower half partition plate first curved surface 321*b*.

The lower half horizontal second abutment flat surface 82*a* is a flat surface which is separated from the lower half partition plate first flat surface 321*a* and faces the lower half partition plate first flat surface 321*a*. The lower half horizontal second abutment flat surface 82*a* is formed in a circular shape having the same diameter as that of the lower half partition plate first flat surface 321*a* when viewed from the inside in the radial direction Dr. The lower half horizontal second abutment curved surface 82*b* is a concave curved surface which abuts against the lower half partition plate first curved surface 321*b*.

The lower half horizontal fixing member 83 fixes the lower half horizontal first abutment portion 81 and the lower half horizontal second abutment portion 82 to the lower half casing 42. The lower half horizontal fixing member 83 is a bolt which is fixed to a bolt hole formed on the lower half partition plate first flat surface 321*a* in a state of penetrating the lower half horizontal first abutment portion 81 and the lower half horizontal second abutment portion 82. The lower half horizontal fixing member 83 fixes the lower half horizontal first abutment portion 81 and the lower half horizontal second abutment portion 82 in a state where the lower half horizontal first abutment flat surface 81*a* is unmovable while being in contact with the lower half partition plate first flat surface 321*a*.

Next, a steam turbine assembling method S1 for assembling the steam turbine 1 will be described. In the present embodiment, a steam turbine assembling method in a case where each part is assembled from the beginning to manufacture the steam turbine 1 will be described. In addition, it should be noted that the present invention is not limited only to the case of manufacturing the steam turbine 1 from the beginning and the steam turbine assembling method S1 may be used when disassembling and assembling the steam turbine 1 for repair or inspection.

Figure 7:
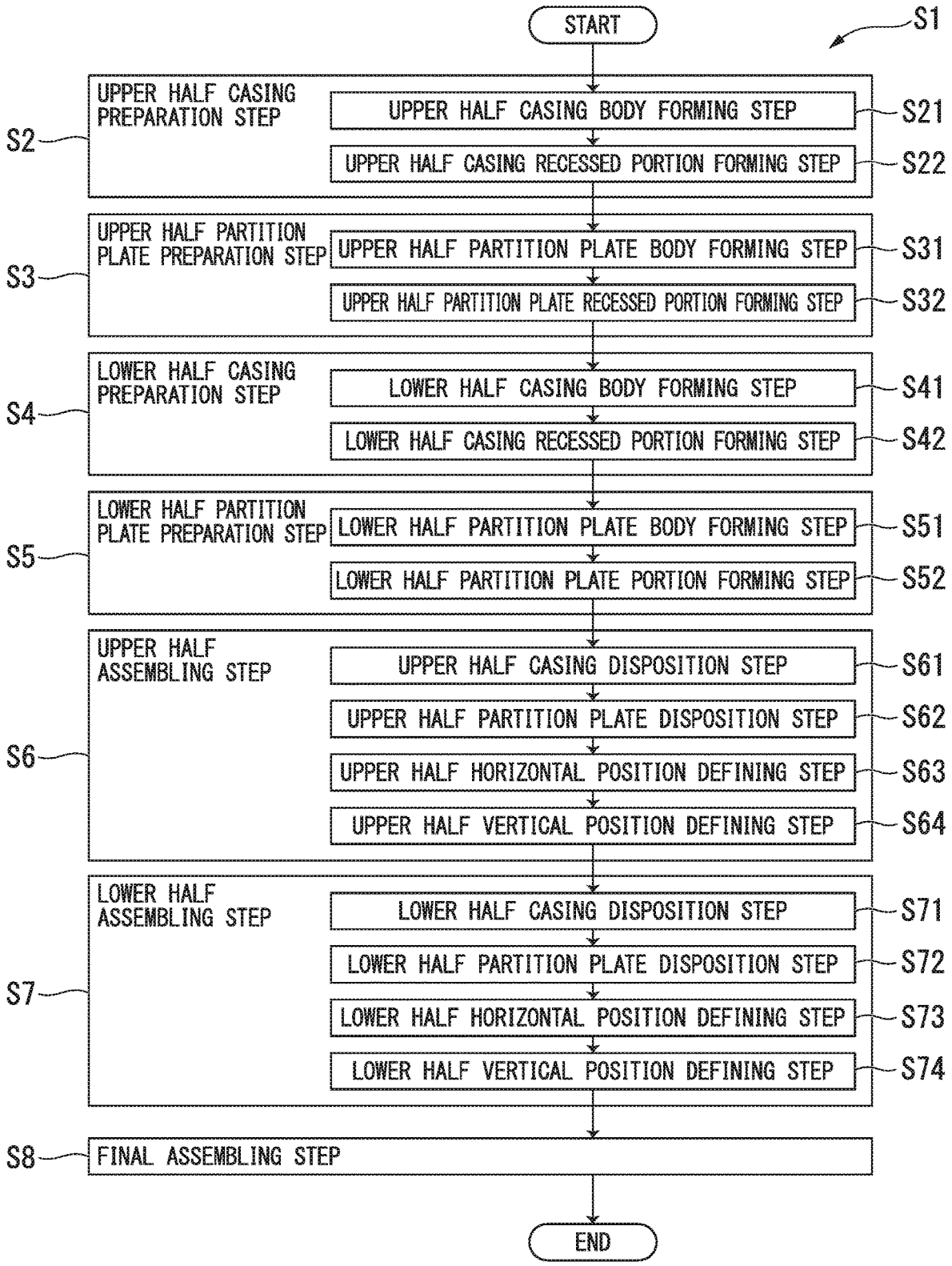
FIG. 7 is a flowchart of a steam turbine assembling method according to the first embodiment of the present invention.

As shown in FIG. 7, the steam turbine assembling method S1 of the present embodiment includes: an upper half casing preparation step S2; an upper half partition plate preparation step S3; a lower half casing preparation step S4; a lower half partition plate preparation step S5; an upper half assembling step S6; a lower half assembling step S7; and a final assembling step S8.

In the upper half casing preparation step S2, the upper half casing 41 is prepared. In the upper half casing preparation step S2 of the present embodiment, the upper half casing 41 is prepared by forming the upper half casing 41. The upper half casing preparation step S2 of the present embodiment includes: an upper half casing body forming step S21; and an upper half casing recessed portion forming step S22.

In the upper half casing body forming step S21, the upper half casing body 410 is formed.

In the upper half casing recessed portion forming step S22, the upper half casing first recessed portions 411 and the upper half casing second recessed portion 412 are formed. The upper half casing recessed portion forming step S22 is performed after the upper half casing body forming step S21. In the upper half casing recessed portion forming step S22, each upper half casing first flat surface 411*a* is formed to be parallel to each upper half casing division surface 41X. In the upper half casing recessed portion forming step S22, the upper half casing second flat surface 412*a* is formed to be parallel to the upper half casing division surface 41X.

In the upper half partition plate preparation step S3, the upper half partition plate 31 is prepared. In the upper half partition plate preparation step S3 of the present embodiment, the upper half partition plate 31 is prepared by forming the upper half partition plate 31. The upper half partition plate preparation step S3 of the present embodiment includes: an upper half partition plate body forming step S31; and the upper half partition plate recessed portion forming step S32.

In the upper half partition plate body forming step S31, the upper half partition plate body 310 is formed.

In the upper half partition plate recessed portion forming step S32, the upper half partition plate first recessed portions 311 and the upper half partition plate second recessed portion 312 are formed. The upper half partition plate recessed portion forming step S32 is performed after the upper half partition plate body forming step S31. In the upper half partition plate recessed portion forming step S32, each upper half partition plate first flat surface 311*a* is formed to be parallel to each upper half partition plate division surface 31X. In the upper half partition plate recessed portion forming step S32, the upper half partition plate second flat surface 312*a* is formed to be parallel to the upper half partition plate division surface 31X.

In the lower half casing preparation step S4, the lower half casing 42 is prepared. In the lower half casing preparation step S4 of the present embodiment, the lower half casing 42 is prepared by forming the lower half casing 42. The lower half casing preparation step S4 of the present embodiment includes: a lower half casing body forming step S41; and a lower half casing recessed portion forming step S42.

In the lower half casing body forming step S41, the lower half casing body 420 is formed.

In the lower half casing recessed portion forming step S42, the lower half casing first recessed portions 421 is formed. The lower half casing recessed portion forming step S42 is performed after the lower half casing body forming step S41. In the lower half casing recessed portion forming step S42, each lower half casing first flat surface 421*a* is formed to be parallel to each lower half casing division surface 42X.

In the lower half partition plate preparation step S5, the lower half partition plate 32 is prepared. In the lower half partition plate preparation step S5, the lower half partition plate 32 is prepared by forming the lower half partition plate 32. The lower half partition plate preparation step S5 of the present embodiment includes: a lower half partition plate body forming step S51; and the lower half partition plate recessed portion forming step S52.

In the lower half partition plate body forming step S51, the lower half partition plate body 320 is formed.

In the lower half partition plate recessed portion forming step S52, the lower half partition plate first recessed portion 321 is formed. The lower half partition plate recessed portion forming step S52 is performed after the lower half partition plate body forming step S51. In the lower half partition plate recessed portion forming step S52, the lower half partition plate second flat surface 322*a* is formed to be parallel to the lower half partition plate division surface 32X.

In addition, the above-described upper half casing preparation step S2, the upper half partition plate preparation step S3, the lower half casing preparation step S4, and the lower half partition plate preparation step S5 may be performed from any step, and thus, the steps may be performed according to any order. Therefore, respective steps may be performed in parallel. In addition, in the upper half casing preparation step S2, the upper half partition plate preparation step S3, the lower half casing preparation step S4, and the lower half partition plate preparation step S5, each member may not be formed and may be prepared in advance.

The upper half assembling step S6 is performed after the upper half casing preparation step S2 and the upper half partition plate preparation step S3. In the upper half assembling step S6, the upper half partition plate 31 is disposed on the inner peripheral side of the upper half casing 41 so as to form the upper half assembly 11. After the upper half partition plate 31 is disposed on the inner peripheral side of the upper half casing 41, the upper half vertical position defining portions 5 are attached to at least one of the upper half casing 41 and the upper half partition plate 31. Accordingly, in the upper half assembling step S6, in a state where a predetermined gap is provided between an inner peripheral surface of the upper half casing 41 and an outer peripheral surface of the upper half partition plate 31, the upper half assembly 11 in which positions thereof in the vertical direction Dv and the horizontal direction Dh are defined such that center positions of the upper half casing 41 and the upper half partition plate 31 are aligned with each other is formed. Specifically, the upper half assembling step S6 of the present embodiment includes: an upper half casing disposition step S61; an upper half partition plate disposition step S62; an upper half horizontal position defining step S63; and an upper half vertical position defining step S64.

In the upper half casing disposition step S61, the upper half casing 41 is disposed in a state where the upper half casing division surface 41X faces upward in the vertical direction Dv.

In the upper half partition plate disposition step S62, the upper half partition plate 31 is disposed on the inner peripheral side of the upper half casing 41 in a state where the upper half partition plate division surface 31X faces upward in the vertical direction Dv. In the upper half partition plate disposition step S62, the upper half partition plate 31 is disposed such that the accommodation space S is formed by aligning the positions of the upper half casing first recessed portion 411 and the upper half partition plate first recessed portion 311.

In the upper half horizontal position defining step S63, the position of the upper half partition plate 31 with respect to the upper half casing 41 in the horizontal direction Dh is defined. In the upper half horizontal position defining step S63, the upper half horizontal position defining portion 7 is fitted into the upper half casing second recessed portion 412 and the upper half partition plate second recessed portion 312. In the upper half horizontal position defining step S63 of the present embodiment, the upper half partition plate 31 is lifted in the vertical direction Dv, and the upper half horizontal first abutment portion 71 is fitted into and fixed to the upper half casing second recessed portion 412 in a state of being unmovable with respect to the upper half casing second recessed portion 412. Thereafter, in a state where the upper half partition plate 31 is lifted in the vertical direction Dv, the upper half horizontal second abutment curved surface 72*b* or the upper half partition plate second curved surface 312*b* is cut off. Accordingly, a horizontal position of the upper half partition plate 31 with respect to the upper half casing 41 is adjusted.

Figure 8:
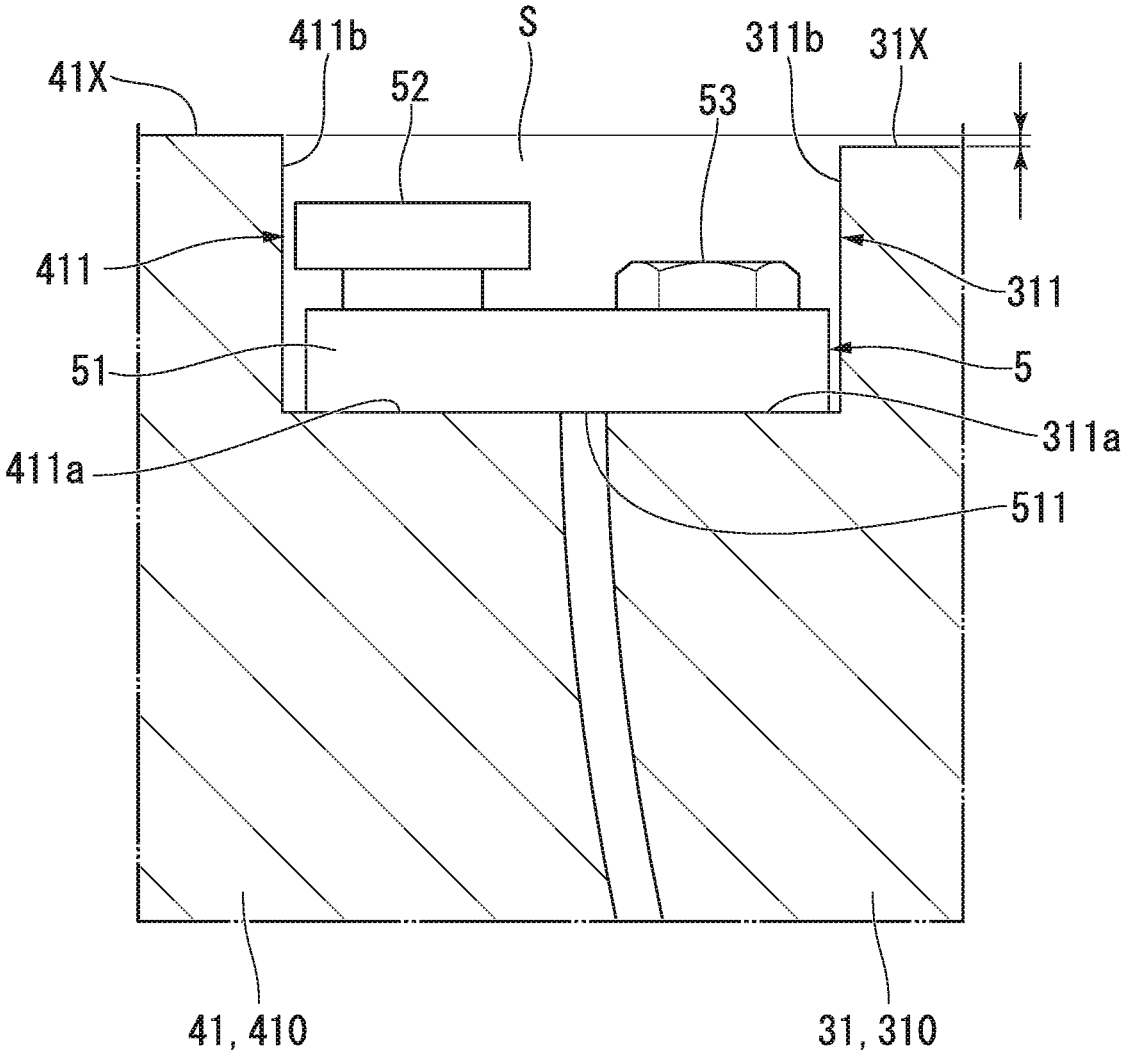
FIG. 8 is a main portion enlarged view showing an upper half vertical position defining step according to the first embodiment of the present invention.

In the upper half vertical position defining step S64, the position of the upper half partition plate 31 with respect to the upper half casing 41 in the vertical direction Dv is defined. The upper half vertical position defining step S64 is performed after the upper half partition plate disposition step S62. In the upper half vertical position defining step S64, as the upper half vertical position defining portion 5, the upper half abutment member 51 is provided in the accommodation space S. In the upper half vertical position defining step S64, in a state where the upper half abutment surface 511 abuts against at least one of the upper half casing first flat surface 411*a* and the upper half partition plate first flat surface 311*a* and in a state where the upper half abutment surface 511 is relatively movable with respect to the other of the upper half casing first flat surface 411*a* and the upper half partition plate first flat surface 311*a* in the vertical direction Dv, the upper half abutment member 51 is fixed. As shown in FIG. 8, in the upper half vertical position defining step S64 of the present embodiment, in a state where the upper half partition plate division surface 31X further protrudes than the upper half casing division surface 41X, the upper half abutment surface 511 abuts against the upper half casing first flat surface 411*a* and the upper half partition plate first flat surface 311*a*, and thus, the upper half abutment member 51 is fixed. Specifically, after the horizontal position is defined in the upper half horizontal position defining step S63, the upper half abutment member 51 is disposed in a state where the upper half abutment surface 511 abuts against the upper half partition plate first flat surface 311*a* and the upper half partition plate first flat surface 311*a*. Thereafter, in a state where the upper half partition plate first flat surface 311*a* and the upper half abutment surface 511 come into contact with each other, the upper half abutment member 51 is fixed in a state of being unmovable with respect to the upper half partition plate first flat surface 311*a*. In addition, after the upper half abutment member 51 is fixed to the upper half partition plate 31, in a state where the upper half casing first flat surface 411*a* and the upper half abutment surface 511 come into contact with each other, the upper half abutment member 51 is fixed in a state of being movable with respect to the upper half casing first flat surface 411*a* which does not come into contact with the upper half abutment surface 511.

The lower half assembling step S7 is performed after the lower half casing preparation step S4 and the lower half partition plate preparation step S5. In the lower half assembling step S7, the lower half partition plate 32 is disposed on the inner peripheral side of the lower half casing 42 to form the lower half assembly 12. After the lower half partition plate 32 is disposed on the inner peripheral side of the lower half casing 42, the lower half vertical position defining portion 6 is attached to at least one of the lower half casing 42 and the lower half partition plate 32. Accordingly, in the lower half assembling step S7, in a state where a predetermined gap is provided between the inner peripheral surface of the lower half casing 42 and the outer peripheral surface of the lower half partition plate 32, the lower half assembly 12 in which positions thereof in the vertical direction Dv and the horizontal direction Dh are defined such that center positions of the lower half casing 42 and the lower half partition plate 32 are aligned with each other is formed. Specifically, the lower half assembling step S7 of the present embodiment includes: a lower half casing disposition step S71; a lower half partition plate disposition step S72; a lower half horizontal position defining step S73; and a lower half vertical position defining step S74.

In the lower half casing disposition step S71, the lower half casing 42 is disposed in a state where the lower half casing division surface 42X faces upward in the vertical direction Dv.

In the lower half partition plate disposition step S72, the lower half partition plate 32 is disposed on the inner peripheral side of the lower half casing 42 in a state where the lower half partition plate division surface 32X faces upward in the vertical direction Dv.

In the lower half horizontal position defining step S73, the position of the lower half partition plate 32 with respect to the lower half casing 42 in the horizontal direction Dh is defined. In the lower half horizontal position defining step S73, the lower half horizontal position defining portion 8 is fitted into the lower half casing first recessed portion 421 and the lower half partition plate first recessed portion 321. In the lower half horizontal position defining step S73 of the present embodiment, the lower half partition plate 32 is lifted in the vertical direction Dv, and the lower half horizontal first abutment portion 81 is fitted into the lower half casing first recessed portion 421 in a state of being unmovable with respect to the lower half casing first recessed portion 421. Thereafter, in a state where the lower half partition plate 32 is lifted in the vertical direction Dv, the lower half horizontal second abutment curved surface 82*b* or the lower half partition plate first curved surface 321*b* is cut off. Accordingly, a horizontal position of the lower half partition plate 32 with respect to the lower half casing 42 is adjusted.

In the lower half vertical position defining step S74, the position of the lower half partition plate 32 with respect to the lower half casing 42 in the vertical direction Dv is defined. The lower half vertical position defining step S74 is performed after the lower half partition plate disposition step S72. In the lower half vertical position defining step S74, as the lower half vertical position defining portion 6, the lower half abutment member 61 is provided. In the lower half vertical position defining step S74, in a state where the lower half abutment surface 611 abuts against the lower half casing division surface 42X and the lower half partition plate division surface 32X, the lower half abutment member 61 is fixed to at least one of the lower half casing 42 and the lower half partition plate 32. In the lower half vertical position defining step S74 of the present embodiment, the lower half abutment member 61 is disposed so as to extend over the lower half casing division surface 42X and the lower half partition plate division surface 32X. Thereafter, the lower half abutment surface 611 abuts against the lower half casing division surface 42X and the lower half partition plate division surface 32X, and the lower half abutment member 61 is fixed to the lower half partition plate 32 in a state of being unmovable with respect to the lower half partition plate 32.

In the final assembling step S8, the upper half casing division surface 41X abuts against the lower half casing division surface 42X so as to install the upper half assembly 11 on the lower half assembly 12. Specifically, in the final assembling step S8, the rotor 2 is disposed on the lower half assembly 12. In a state where the rotor 2 is disposed, the upper half assembly 11, in which the upper half partition plate division surface 31X is movable to protrude in the vertical direction Dv with respect to the upper half casing division surface 41X, is placed on the lower half assembly 12. In this case, the upper half casing division surface 41X abuts against the lower half casing division surface 42X, and thus, the upper half partition plate division surface 31X which further protrudes than the upper half casing division surface 41X come into contact with the lower half partition plate division surface 32X so as to be pushed. As a result, the upper half partition plate 31 moves with respect to the upper half casing 41 in a state where the upper half partition plate division surface 31X abuts against the lower half partition plate division surface 32X. Accordingly, the steam turbine 1 is formed in a state where the upper half casing division surface 41X abuts against the lower half casing division surface 42X and the upper half partition plate division surface 31X abuts against the lower half partition plate division surface 32X.

According to the above-described steam turbine assembling method S1, the steam turbine 1, and the upper half assembly 11, the upper half vertical position defining portions 5 are attached after the upper half partition plate 31 is disposed on the inner peripheral side of the upper half casing 41. The upper half vertical position defining portions 5 make the upper half partition plate division surface 31X be movable relative to the upper half casing division surface 41X such that the upper half partition plate division surface 31X protrudes with respect to the upper half casing division surface 41X in the vertical direction Dv. Accordingly, the positions of the upper half casing division surface 41X and the upper half partition plate division surface 31X can be defined in a state where the upper half casing 41 and the upper half partition plate 31 are assembled together.

In addition, when the upper half assembly 11 and the lower half assembly 12 are combined with each other, the upper half partition plate division surface 31X and the upper half casing division surface 41X faces downward in the vertical direction Dv. As a result, the upper half partition plate 31 is lowered by its own weight in a state where the movement thereof is regulated by the upper half abutment member 51, and the upper half partition plate division surface 31X further protrudes downward in the vertical direction Dv than the upper half casing division surface 41X. Accordingly, when the upper half assembly 11 is placed on the lower half assembly 12 while the upper half casing division surface 41X abuts against the lower half casing division surface 42X, the lower half partition plate division surface 32X and the upper half partition plate division surface 31X come into contact with each other at high accuracy. Thereafter, the upper half partition plate 31 moves relative to the upper half casing 41 in the vertical direction Dv in a state where the lower half partition plate division surface 32X and the upper half partition plate division surface 31X come into contact with each other. As a result, in a state where the upper half partition plate division surface 31X and the lower half partition plate division surface 32X come into contact with each other, the upper half casing division surface 41X and the lower half casing division surface 42X come into contact with each other, and the upper half assembly 11 and the lower half assembly 12 are combined with each other. Accordingly, by only placing the upper half assembly 11 on the lower half assembly 12, the lower half partition plate division surface 32X and the upper half partition plate division surface 31X can come into contact with the lower half partition plate division surface 32X and the upper half partition plate division surface 31X at high accuracy. Accordingly, it is possible to suppress occurrence of a gap between the upper half assembly 11 and the lower half assembly 12 while decreasing the amount of adjustment needed in positioning.

In addition, the upper half abutment member 51 is fixed in the state where the upper half partition plate first flat surface 311*a* and the upper half abutment surface 511 abut against each other and in the state where the upper half abutment surface 511 is movable with respect to the upper half casing first flat surface 411*a* in the vertical direction Dv. Accordingly, after the upper half casing 41 and the upper half partition plate 31 are assembled together, the upper half partition plate 31 and the upper half casing 41 are connected to each other to be movable via the upper half abutment member 51. Therefore, by the upper half abutment member 51, the upper half partition plate division surface 31X can be made movable so as to protrude in the vertical direction Dv with respect to the upper half casing division surface 41X. Accordingly, the adjustment needed in positioning can be easily performed by only fixing the upper half abutment member 51.

In addition, the upper half abutment member 51 is disposed in the accommodation space S. Accordingly, the upper half abutment member 51 can be disposed so as not to protrude from the upper half casing division surface 41X and the upper half partition plate division surface 31X. Accordingly, when the upper half assembly 11 and the lower half assembly 12 are combined with each other, it is possible to prevent the upper half abutment member 51 from being disposed between the lower half partition plate division surface 32X and the upper half partition plate division surface 31X or at an interference position between the lower half partition plate division surface 32X and the upper half partition plate division surface 31X. Therefore, when the upper half assembly 11 and the lower half assembly 12 are combined together, it is possible to prevent the upper half abutment member 51 from becoming an obstacle.

In addition, the upper half abutment member 51 is disposed in a state where the upper half partition plate division surface 31X faces upward in the vertical direction Dv. Accordingly, a worker can attach the upper half abutment member 51 to the upper half partition plate 31 and the upper half casing 41 from the upper portion in the vertical direction Dv. Therefore, when the upper half abutment member 51 is fixed to the upper half partition plate 31 or the upper half casing 41, it is unnecessary to perform a work so as to get the upper half abutment member 51 in from the lower portion in the vertical direction Dv with respect to the upper half partition plate 31 and the upper half casing 41. As a result, the upper half abutment member 51 is easily attached to the upper half partition plate 31 and the upper half casing 41.

In addition, the upper half casing first flat surface 411*a* and the upper half casing division surface 41X are formed to be parallel to each other, and the upper half partition plate first flat surface 311*a* and the upper half partition plate division surface 31X are formed to be parallel to each other. Accordingly, by only adjusting the positions of the parallel surfaces of the upper half casing first flat surface 411*a* and the upper half casing division surface 41X in the vertical direction Dv and the positions of the parallel surfaces of the upper half partition plate first flat surface 311*a* and the upper half partition plate division surface 31X in the vertical direction Dv, the positions of the upper half casing division surface 41X and the upper half partition plate division surface 31X are adjusted when the upper half abutment member 51 is attached. Therefore, it is possible to easily perform delicate adjustment of a protrusion amount of the upper half partition plate division surface 31X with respect to the upper half casing division surface 41X.

In addition, in the upper half vertical position defining step S64, the upper half abutment surface 511 abuts against the upper half casing first flat surface 411*a* and the upper half partition plate first flat surface 311*a*, and thus, the upper half abutment member 51 is fixed. Accordingly, when the upper half abutment member 51 is attached, it is not necessary to finely adjust the position of the upper half abutment surface 511 with respect to the upper half casing first flat surface 411*a* and the upper half partition plate first flat surface 311*a*. Therefore, it is possible to easily attach the upper half abutment member 51 to the upper half partition plate 31 and the upper half casing 41.

In addition, after the lower half partition plate 32 is disposed on the inner peripheral side of the lower half casing 42, the lower half vertical position defining portion 6 is attached. Specifically, by the lower half vertical position defining portion 6, the lower half abutment member 61 is fixed in a state where the lower half abutment surface 611 abuts against the lower half casing division surface 42X and the lower half partition plate division surface 32X. The lower half casing division surface 42X and the lower half partition plate division surface 32X come into contact with the lower half abutment surface 611, and thus, the lower half casing division surface 42X and the lower half partition plate division surface 32X are disposed on the same horizontal surface as each other. Accordingly, the positions of the lower half casing division surface 42X and the lower half partition plate division surface 32X in the vertical direction Dv can be defined in a state where the lower half casing 42 and the lower half partition plate 32 are assembled together.

In addition, the lower half abutment member 61 is fixed to the lower half partition plate 32, and thus, the state where the lower half casing division surface 42X and the lower half partition plate division surface 32X are disposed on the same horizontal surface as each other is maintained. Accordingly, by only fixing the lower half abutment member 61 to the lower half partition plate 32, it is possible to define the positions of the lower half casing 42 and the lower half partition plate 32 in the vertical direction Dv while decreasing the amount of adjustment needed in positioning of the lower half assembly 12. The positions of the lower half casing division surface 42X and the lower half partition plate division surface 32X are maintained on the same horizontal surface, and thus, it is possible to suppress occurrence of a gap between the upper half assembly 11 and the lower half assembly 12.

In addition, the lower half abutment member 61 is disposed so as to be positioned in the accommodation space S. Accordingly, when the upper half assembly 11 and the lower half assembly 12 are combined with each other, it is possible to prevent the lower half abutment member 61 from being disposed between the lower half partition plate division surface 32X and the upper half partition plate division surface 31X or at an interference position between the lower half partition plate division surface 32X and the upper half partition plate division surface 31X. Therefore, when the upper half assembly 11 and the lower half assembly 12 are combined with each other, it is possible to prevent the lower half abutment member 61 from becoming an obstacle.

Second Embodiment

Next, the steam turbine and the steam turbine assembling method according to the second embodiments of the present invention will be described. The upper half vertical position defining portion and the lower half vertical position defining portion of a steam turbine according to the second embodiment are different from those according to the first embodiment. Accordingly, in descriptions of the second embodiment, the reference numerals are assigned to the same portions as those according to the first embodiment, and overlapping descriptions are omitted. That is, descriptions of the entire configuration of the steam turbine and the steam turbine assembling method common to the configuration described in the first embodiment are omitted.

The steam turbine 1 according to the second embodiment includes: the rotor 2; a partition plate 3A; a casing 4A; an upper half vertical position defining portion (upper half position defining portion) 5A; an upper half vertical position provisional defining portion 9; the upper half horizontal position defining portion 7; and the lower half horizontal position defining portion 8.

Figure 9:
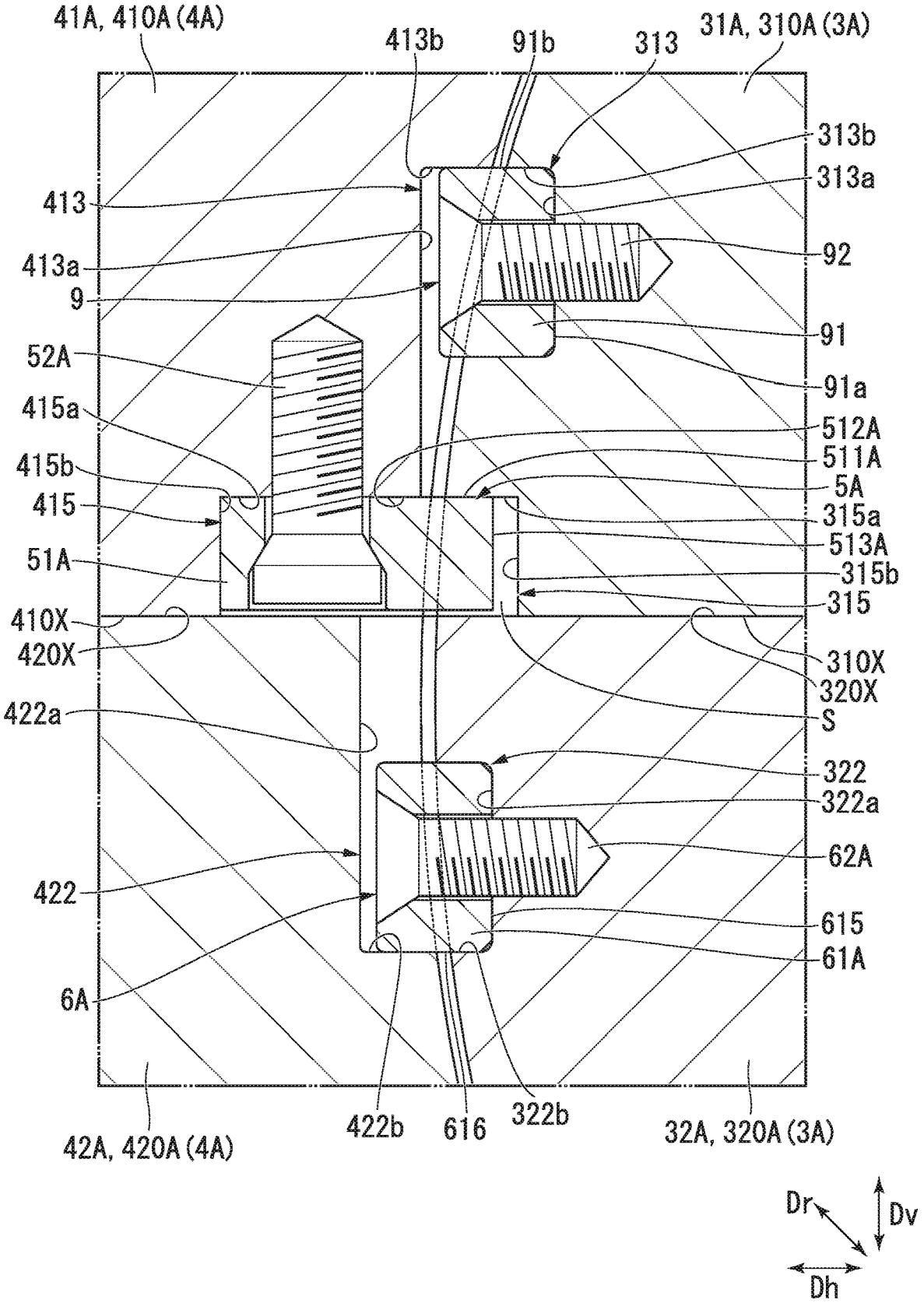
FIG. 9 is a main portion enlarged view showing an upper half vertical position defining member and a lower half vertical position defining member according to a second embodiment of the present invention.

As shown in FIG. 9, an upper half casing 41A of the second embodiment includes an upper half casing first recessed portion (upper half casing recessed portion) 415 which is different from that of the first embodiment. The upper half casing 41A further includes an upper half casing third recessed portion 413.

The upper half casing first recessed portions 415 and the upper half casing third recessed portions 413 of the second embodiment are respectively separated from each other in the horizontal direction Dh to be symmetrically formed to each other in a similar manner to the upper half casing first recessed portions 411 of the first embodiment. Here, the upper half casing first recessed portion 415 and the upper half casing third recessed portion 413, which are positioned on one side in the horizontal direction Dh which is the right side in the paper surface in FIG. 2, are described as an example. In addition, the upper half casing first recessed portion 415 and the upper half casing third recessed portion 413 positioned on the other side in the horizontal direction Dh, which are not described, have the same shape.

The upper half casing first recessed portion 415 of the second embodiment is recessed upward in the vertical direction Dv on an inner peripheral side of an upper half casing division surface 410X. The upper half casing first recessed portion 415 is formed at a corner which is formed by an inner peripheral surface of an upper half casing body 410A and the upper half casing division surface 410X. The upper half casing first recessed portion 415 includes: an upper half casing first flat surface (upper half casing recess surface) 415*a* facing in a direction including the vertical direction Dv; and an upper half casing first curved surface 415*b* facing the inside in the radial direction Dr.

The upper half casing first flat surface 415*a* is a surface which spreads in the radial direction Dr and the axial direction Da so as to face in the direction including the vertical direction Dv. Similarly to the first embodiment, the upper half casing first flat surface 415*a* of the second embodiment is a horizontal surface facing downward in the vertical direction Dv. Accordingly, the upper half casing first flat surface 415*a* is formed to be parallel to the upper half casing division surface 410X. When the upper half casing 41A and the lower half casing 42A are combined with each other, the upper half casing first flat surface 415*a* is positioned above the upper half casing division surface 410X in the vertical direction Dv. A bolt hole is formed in the upper half casing first flat surface 415*a*.

The upper half casing first curved surface 415*b* is connected to the upper half casing division surface 410X and the upper half casing first flat surface 415*a*. The upper half casing first curved surface 415*b* spreads in a direction orthogonal to the upper half casing division surface 410X and the upper half casing first flat surface 415*a*. The upper half casing first curved surface 415*b* is a concave curved surface facing the inside in the radial direction Dr. The upper half casing first curved surface 415*b* extends in the vertical direction Dv from the upper half casing division surface 410X. The upper half casing first curved surface 415*b* is formed approximately half the length of the upper half casing first curved surface 411*b* of the first embodiment.

The upper half casing third recessed portion 413 is recessed from an inner peripheral surface of the upper half casing body 410A toward the outside in the radial direction Dr. The upper half casing third recessed portion 413 is formed slightly above the upper half casing division surface 410X in the vertical direction Dv such that the upper half casing third recessed portion 413 communicates with the upper half casing first recessed portion 415. The upper half casing third recessed portion 413 includes: an upper half casing third flat surface 413*a* which faces the inside in the radial direction Dr; and an upper half casing third side surface 413*b* facing in the vertical direction Dv.

The upper half casing third flat surface 413*a* connects the upper half casing first flat surface 415*a* and the upper half casing third side surface 413*b* to each other. The upper half casing third flat surface 413*a* spreads in a direction orthogonal to the upper half casing first flat surface 415*a* and the upper half casing third side surface 413*b*. The upper half casing third flat surface 413*a* is a surface facing in the horizontal direction Dh. The upper half casing third flat surface 413*a* extends in the vertical direction Dv from the upper half casing first flat surface 415*a*.

The upper half casing third side surface 413*b* is a surface which spreads in the radial direction Dr and the axial direction Da. The upper half casing third side surface 413*b* is a surface which perpendicularly extends from the inner peripheral surface of the upper half casing body 410A.

The lower half casing 42A of the second embodiment further includes a lower half casing second recessed portion 422.

The lower half casing second recessed portions 422 are respectively formed symmetrically on two lower half casing division surfaces 420X separated from each other in the horizontal direction Dh. Here, the lower half casing second recessed portion 422 positioned on the one side in the horizontal direction Dh is described as an example. In addition, the lower half casing second recessed portion 422 positioned on the other side in the horizontal direction Dh, which is not described, has the same shape.

The lower half casing second recessed portion 422 is recessed downward in the vertical direction Dv on the inner peripheral side of the lower half casing division surface 420X. The lower half casing second recessed portion 422 is formed at a corner which is formed by an inner peripheral surface of a lower half casing body 420A and a lower half casing division surface 420X. When the upper half casing 41A is combined with the lower half casing 42A, the lower half casing second recessed portion 422 is formed at a position at which the lower half casing second recessed portion 422 communicates with the upper half casing first recessed portion 415. The lower half casing second recessed portion 422 includes: a lower half casing second flat surface 422*a* which faces in the direction including the vertical direction Dv; and a lower half casing second side surface 422*b* which faces the inside in the radial direction Dr.

The lower half casing second flat surface 422*a* connects the lower half casing division surface 420X and the lower half casing second side surface 422*b*. The lower half casing second flat surface 422*a* spreads in a direction orthogonal to the lower half casing division surface 420X and the lower half casing second side surface 422*b*. The lower half casing second flat surface 422*a* is a surface which faces the inside in the radial direction Dr. The lower half casing second flat surface 422*a* extends in the vertical direction Dv from the lower half casing division surface 420X.

The lower half casing second side surface 422*b* is a surface which spreads in the radial direction Dr and the axial direction Da. The lower half casing second side surface 422*b* is a surface which extends perpendicularly from an inner peripheral surface of the lower half casing body 420A. When the upper half casing 41A and the lower half casing 42A are combined with each other, the lower half casing second side surface 422*b* is positioned below the lower half casing division surface 420X in the vertical direction Dv. The length of the lower half casing second side surface 422*b* in the horizontal direction Dh is shorter than a length of the upper half casing first flat surface 415*a* in the horizontal direction Dh.

An upper half partition plate 31A of the second embodiment includes an upper half partition plate first recessed portion (upper half partition plate recessed portion) 315 which is different from that of the first embodiment. The upper half partition plate 31A further includes an upper half partition plate third recessed portion 313.

Similarly to the upper half partition plate first recessed portions 311 of the first embodiment, the upper half partition plate first recessed portions 315 and the upper half partition plate third recessed portions 313 of the second embodiment are respectively separated from each other in the horizontal direction Dh to be symmetrically formed to each other. Here, the upper half partition plate first recessed portion 315 and the upper half partition plate third recessed portion 313, which are positioned on one side in the horizontal direction Dh which is the right side in the paper surface in FIG. 2, are described as an example. In addition, the upper half partition plate first recessed portion 315 and the upper half partition plate third recessed portion 313 positioned on the other side in the horizontal direction Dh, which are not described, have the same shape.

The upper half partition plate first recessed portion 315 of the second embodiment is recessed upward in the vertical direction Dv on an inner peripheral side of an upper half partition plate division surface 310X. The upper half partition plate first recessed portion 315 is formed at a corner which is formed by an inner peripheral surface of the upper half partition plate body 310A and the upper half partition plate division surface 310X. The upper half partition plate first recessed portion 315 forms an accommodation space S which communicates with the upper half casing first recessed portion 415 when the upper half partition plate first recessed portion 315 is disposed on the inner peripheral side of the upper half casing 41A. Accordingly, the upper half partition plate first recessed portion 315 of the present embodiment is formed such that positions thereof in the circumferential direction Dc and the axial direction Da are the same as those of the upper half casing first recessed portion 415 in a state where the upper half partition plate 31A is disposed on the inner peripheral side of the upper half casing 41A. As shown in FIG. 3, the upper half partition plate first recessed portion 315 includes: an upper half partition plate first flat surface (upper half partition plate recess surface) 315*a* facing in the direction including the vertical direction Dv; and an upper half partition plate first curved surface 315*b* facing the outside in the radial direction Dr.

The upper half partition plate first flat surface 315*a* is a surface which spreads in the radial direction Dr and the axial direction Da so as to face in the direction including the vertical direction Dv. The upper half partition plate first flat surface 315*a* of the present embodiment is a horizontal surface facing downward in the vertical direction Dv. Accordingly, the upper half partition plate first flat surface 315*a* is a flat surface which is parallel to the upper half partition plate division surface 310X. When the upper half partition plate 31A and the lower half partition plate 32A are combined with each other, the upper half partition plate first flat surface 315*a* is positioned above the upper half partition plate division surface 310X in the vertical direction Dv. In a case where the upper half partition plate division surface 310X and the upper half casing division surface 410X are disposed on the same plane as each other in a state where the upper half partition plate 31A is disposed on the inner peripheral side of the upper half casing 41A, the upper half partition plate first flat surface 315*a* is formed to be positioned on a side which is farther from the upper half partition plate division surface 310X and the upper half casing division surface 410X than the upper half casing first flat surface 415*a*.

The upper half partition plate first curved surface 315*b* connects the upper half partition plate division surface 310X and the upper half partition plate first flat surface 315*a* to each other. The upper half partition plate first curved surface 315*b* spreads in a direction orthogonal to the upper half partition plate division surface 310X and the upper half partition plate first flat surface 315*a*. The upper half partition plate 31A casing 4A first curved surface is a concave curved surface which faces the outside in the radial direction Dr. The upper half partition plate first curved surface 315*b* extends in the vertical direction Dv from the upper half partition plate division surface 310X. A length of the upper half partition plate first curved surface 315*b* in the vertical direction Dv is longer than a length of the upper half casing first curved surface 415*b* in the vertical direction Dv.

The upper half partition plate third recessed portion 313 is recessed from an outer peripheral surface of the upper half partition plate body 310A toward the inside in the radial direction Dr. The upper half partition plate third recessed portion 313 is formed at a position which is further separated from the upper half partition plate division surface 310X than the upper half partition plate first recessed portion 315. The upper half partition plate third recessed portion 313 is formed at a position which is separated from the upper half partition plate first recessed portion 315. The upper half partition plate third recessed portion 313 is formed such that the positions thereof in the circumferential direction Dc and the axial direction Da are the same as those of the upper half casing third recessed portion 413 in a state where the upper half partition plate 31A is disposed on the inner peripheral side of the upper half casing 41A. The upper half partition plate third recessed portion 313 includes: an upper half partition plate third flat surface 313*a* which faces the outside in the radial direction Dr; and an upper half partition plate third side surface 313*b* which connects the outer peripheral surface of the upper half partition plate body 310A and the upper half partition plate third flat surface 313*a* to each other.

The upper half partition plate third flat surface 313*a* is a flat surface which faces the outside in the radial direction Dr. The upper half partition plate third flat surface 313*a* is formed in a circular shape when viewed from the outside in the radial direction Dr. The upper half partition plate third flat surface 313*a* faces the upper half casing third flat surface 413*a* in a state where the upper half partition plate 31A is disposed on the inner peripheral side of the upper half casing 41A. A bolt hole is formed on the upper half partition plate third flat surface 313*a*.

The upper half partition plate third side surface 313*b* connects the outer peripheral surface of the upper half partition plate body 310A and the upper half partition plate third flat surface 313*a* to each other. The upper half partition plate third side surface 313*b* is a concave curved surface which extends in the horizontal direction Dh from the outer peripheral surface of the upper half partition plate body 310A.

The lower half partition plate 32A of the second embodiment further includes a lower half partition plate second recessed portion 322.

The lower half partition plate second recessed portions 322 are respectively formed symmetrically on two lower half partition plate division surfaces 320X separated from each other in the horizontal direction Dh. Here, the lower half partition plate second recessed portion 322 positioned on the one side in the horizontal direction Dh is described as an example. In addition, the lower half partition plate second recessed portion 322 positioned on the other side in the horizontal direction Dh, which is not described, has the same shape.

The lower half partition plate second recessed portion 322 of the second embodiment is recessed from an outer peripheral surface of the lower half partition plate body 320A toward the inside in the radial direction Dr. The lower half partition plate second recessed portion 322 is formed at a position which is separated from the lower half partition plate division surface 320X. The lower half partition plate second recessed portion 322 is formed such that the positions thereof in the circumferential direction Dc and the axial direction Da are the same as those of the lower half casing second recessed portion 422 in a state where the lower half partition plate 32A is disposed on the inner peripheral side of the lower half casing 42A. The lower half partition plate second recessed portion 322 has the same shape as that of the upper half partition plate third recessed portion 313. The lower half partition plate second recessed portion 322 includes: a lower half partition plate second flat surface 322*a* which faces the outside in the radial direction Dr; and a lower half partition plate second side surface 322*b* which connects the outer peripheral surface of the lower half partition plate body 320A and the lower half partition plate second flat surface 322*a* to each other.

The lower half partition plate second flat surface 322*a* is a flat surface which faces the outside in the radial direction Dr. The lower half partition plate second flat surface 322*a* is formed in a circular shape when viewed from the outside in the radial direction Dr. The lower half partition plate second flat surface 322*a* faces the lower half casing second flat surface 422*a* in a state where the lower half partition plate 32A is disposed on the inner peripheral side of the lower half casing 42A. A bolt hole is formed on the lower half partition plate second flat surface 322*a*.

The lower half partition plate second side surface 322*b* connects the outer peripheral surface of the lower half partition plate body 320A and the lower half partition plate second flat surface 322*a* to each other. The lower half partition plate second side surface 322*b* is a concave curved surface which extends in the horizontal direction Dh from the outer peripheral surface of the lower half partition plate body 320A.

The upper half vertical position defining portion 5A of the second embodiment includes: an upper half abutment member 51A; and an upper half first fixing member 52A.

The upper half abutment member 51A of the second embodiment is fixed to the upper half casing 41A in the accommodation space S. The upper half abutment member 51A regulates a relative movement of the upper half partition plate first flat surface 315*a* with respect to the upper half casing first flat surface 415*a* in the vertical direction Dv. The upper half abutment member 51A regulates the position of the upper half partition plate first flat surface 315*a* with respect to the upper half casing first flat surface 415*a* such that the upper half partition plate first flat surface 315*a* is not closer to the upper half casing division surface 410X side than the upper half casing first flat surface 415*a*. That is, the upper half abutment member 51A prevents the upper half partition plate first flat surface 315*a* from protruding in the vertical direction Dv from the upper half casing first flat surface 415*a*. The upper half abutment member 51A is a block-shaped member which is formed to have a size which can be accommodated in the accommodation space S. The upper half abutment member 51A includes: an upper half abutment surface 511A which faces the upper half casing first flat surface 415*a* and the upper half partition plate first flat surface 315*a*; an upper half separation surface 512A which is separated from the upper half abutment surface 511A and faces a side opposite to the upper half abutment surface 511A; and an upper half connection side surface 513A which connects the upper half abutment surface 511A and the upper half separation surface 512A to each other.

The upper half abutment surface 511A can abut against the upper half casing first flat surface 415*a* and the upper half partition plate first flat surface 315*a*. The upper half abutment surface 511A is a flat surface which is parallel to the upper half casing first flat surface 415*a* and the upper half partition plate first flat surface 315*a*. In the state where the upper half assembly 11 is installed on the lower half assembly 12, the upper half abutment surface 511A is formed at a position at which the upper half abutment surface 511A comes into contact with only the upper half casing first flat surface 415*a* and a gap is formed between the upper half abutment surface 511A and the upper half partition plate first flat surface 315*a*.

The upper half separation surface 512A is a flat surface which is parallel to the upper half abutment surface 511A. The upper half separation surface 512A is formed in the same shape as that of the upper half abutment surface 511A. That is, the upper half separation surface 512A is formed in an elliptical shape. The upper half separation surface 512A is formed to be closer to the upper half partition plate first flat surface 315*a* side and the upper half casing first flat surface 415*a* side than the upper half partition plate division surface 310X and the upper half casing division surface 410X in a state where the upper half abutment member 51A is disposed in the accommodation space S.

The upper half connection side surface 513A is a side surface which is orthogonal to the upper half abutment surface 511A and the upper half separation surface 512A. The upper half connection side surface 513A is formed at a position at which a gap is formed between the upper half partition plate first curved surface 315*b* and the upper half casing first curved surface 415*b* in the state where the upper half abutment member 51A is disposed in the accommodation space S.

The upper half first fixing member 52A fixes the upper half abutment member 51A to the upper half casing 41A. The upper half first fixing member 52A is a bolt which is fixed to a bolt hole formed on the upper half casing first flat surface 415*a* in a state of being inserted into a through-hole formed in the upper half abutment member. The upper half first fixing member 52A fixes the upper half abutment member 51A in a direction orthogonal to the upper half casing division surface 410X. The upper half first fixing member 52A fixes the upper half abutment member 51A in a state of being unmovable with respect to the upper half casing 41A.

The upper half vertical position provisional defining portion 9 defines the position of the upper half partition plate 31A with respect to the upper half casing 41A in the vertical direction Dv in a state where the upper half partition plate 31A is disposed on the inner peripheral side of the upper half casing 41A in which the upper half casing division surface 410X is disposed to face upward in the vertical direction Dv. The upper half vertical position provisional defining portion 9 defines a position of the upper half partition plate 31A in a direction away from the upper half casing division surface 410X with respect to the upper half casing 41A. The upper half vertical position provisional defining portion 9 is provided in the upper half casing third recessed portion 413 and the upper half partition plate third recessed portion 313. The upper half vertical position provisional defining portion 9 of the present embodiment includes: an upper half vertical third abutment portion 91 which is inserted into the upper half partition plate third recessed portion 313; and an upper half vertical third fixing member 92 which fixes the upper half vertical third abutment portion 91.

The upper half vertical third abutment portion 91 is fitted into the upper half partition plate third recessed portion 313. The upper half vertical third abutment portion 91 is formed in a disk shape corresponding to the upper half partition plate third recessed portion 313. The upper half vertical third abutment portion 91 includes: an upper half vertical third abutment flat surface 9*a* which faces the upper half partition plate first flat surface 315*a*; and an upper half vertical third abutment side surface 91*b* which faces the upper half partition plate third side surface 313*b*.

The upper half vertical third abutment flat surface 9*a* is a flat surface which abuts against the upper half partition plate third flat surface 313*a*. The upper half vertical third abutment flat surface 9*a* is formed in a circular shape having the same diameter as that of the upper half partition plate third flat surface 313*a* when viewed from the outside in the radial direction Dr. The upper half vertical third abutment side surface 91*b* is a concave curved surface which abuts against the upper half partition plate third side surface 313*b*. A portion of the upper half vertical third abutment side surface 91*b* abuts against the upper half casing third side surface 413*b*.

The upper half vertical third fixing member 92 fixes the upper half vertical third abutment portion 91 to the upper half partition plate 31A. The upper half vertical third fixing member 92 is a bolt which is fixed to a bolt hole formed in the upper half partition plate third flat surface 313*a* in a state of penetrating the upper half vertical third abutment portion 91. The upper half vertical third fixing member 92 fixes the upper half vertical third abutment portion 91 in a state where the upper half vertical third abutment flat surface 9*a* is unmovable with respect to the upper half partition plate third flat surface 313*a* while coming into contact with the upper half partition plate third flat surface 313*a*.

The lower half vertical position defining portion 6A defines the position of the lower half partition plate 32A with respect to the lower half casing 42A in the vertical direction Dv in a case where the lower half partition plate 32A is disposed on the inner peripheral side of the lower half casing 42A in which the lower half casing division surface 420X is disposed to face upward in the vertical direction Dv. The lower half vertical position defining portion 6A defines a position of the lower half partition plate 32A in a direction away from the lower half casing division surface 420X with respect to the lower half casing 42A. The lower half vertical position defining portion 6A is provided in the lower half casing second recessed portion 422 and the lower half partition plate second recessed portion 322. The lower half vertical position defining portion 6A of the present embodiment includes: a lower half vertical second abutment portion 61A which is inserted into the lower half partition plate second recessed portion 322; and a lower half vertical second fixing member 62A which fixes the lower half vertical second abutment portion 61A.

The lower half vertical second abutment portion 61A is fitted into the lower half partition plate second recessed portion 322. The lower half vertical second abutment portion 61A is formed in a disk shape corresponding to the lower half partition plate second recessed portion 322. The lower half vertical second abutment portion 61A includes: a lower half vertical second abutment flat surface 615 which faces the lower half partition plate second flat surface 322*a*; and a lower half vertical second abutment side surface 616 which faces the lower half partition plate second side surface 322*b*.

The lower half vertical second abutment flat surface 615 is a flat surface which abuts against the lower half partition plate second flat surface 322*a*. The lower half vertical second abutment flat surface 615 is formed in a circular shape having the same diameter as that of the lower half partition plate second flat surface 322*a* when viewed from the outside in the radial direction Dr. The lower half vertical second abutment side surface 616 is a concave curved surface which abuts against the lower half partition plate second side surface 322*b*. A portion of the lower half vertical second abutment side surface 616 abuts against the lower half casing second side surface 422*b*.

The lower half vertical second fixing member 62A fixes the lower half vertical second abutment portion 61A to the lower half partition plate 32A. The lower half vertical second fixing member 62A is a bolt which is fixed to a bolt hole formed in the lower half partition plate second flat surface 322*a* in a state of penetrating the lower half vertical second abutment portion 61A. The lower half vertical second fixing member 62A fixes the lower half vertical second abutment portion 61A in a state where the lower half vertical second abutment flat surface 615 is unmovable with respect to the lower half partition plate second flat surface 322*a* while coining into contact with the lower half partition plate second flat surface 322*a*.

Next, a method S10 for assembling steam turbine of the second embodiment will be described.

Figure 10:
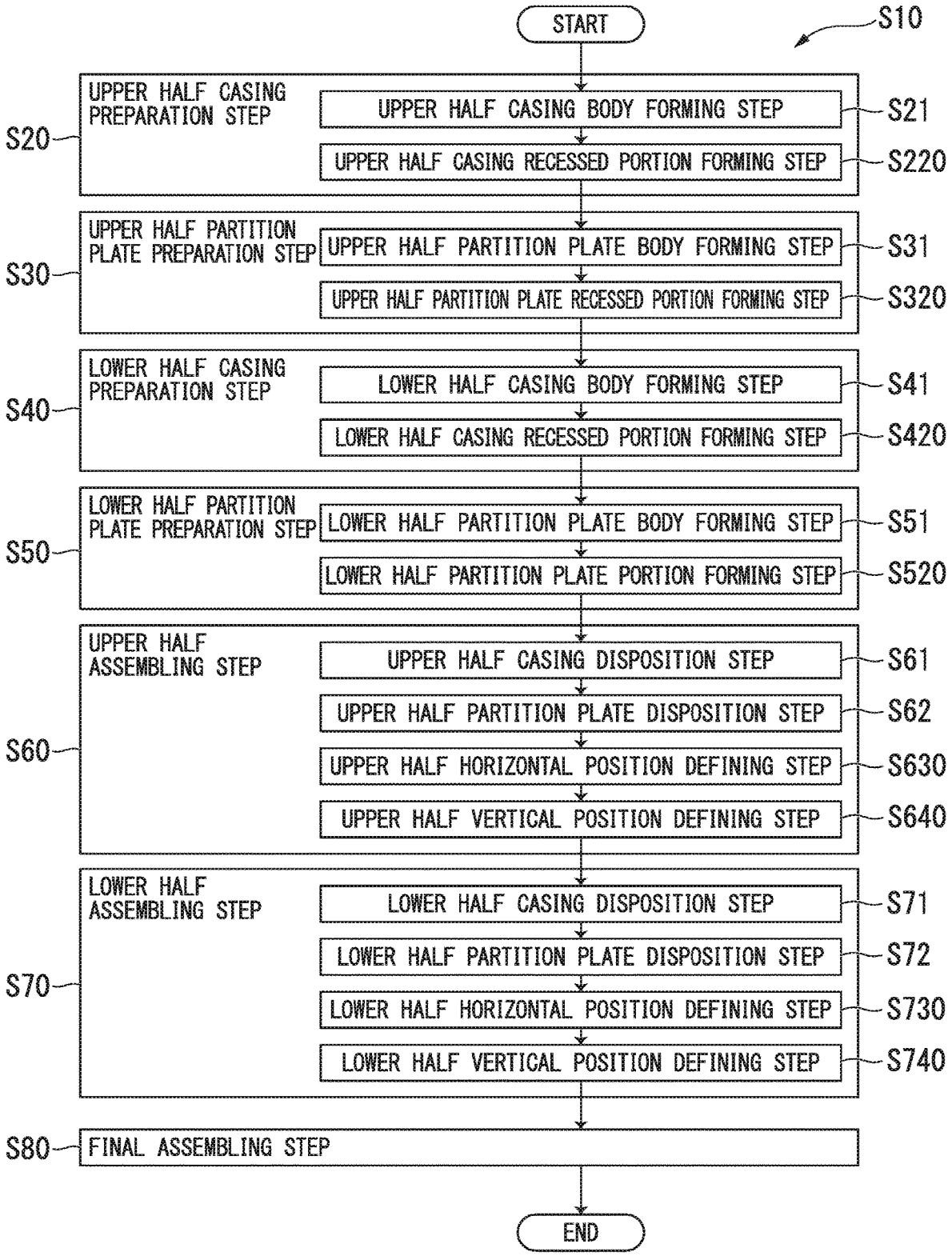
FIG. 10 is a flowchart of the steam turbine assembling method according to the first embodiment of the present invention.

As shown in FIG. 10, the steam turbine assembling method S10 includes: an upper half casing preparation step S20; an upper half partition plate preparation step S30; a lower half casing preparation step S40; a lower half partition plate preparation step S50; an upper half assembling step S60; a lower half assembling step S70; and a final assembling step S80.

In the steam turbine assembling method S10 of the second embodiment, in an upper half casing recessed portion forming step S220, the upper half casing first recessed portion 415 and an upper half casing second recessed portion 412 are formed. In an upper half partition plate recessed portion forming step S320, the upper half partition plate first recessed portion 315, the upper half partition plate second recessed portion 312, and the upper half partition plate third recessed portion 313 are formed. In a lower half casing recessed portion forming step S420, the lower half casing first recessed portion 421 and the lower half casing second recessed portion 422 are formed. In a lower half partition plate recessed portion forming step S520, the lower half partition plate first recessed portion 321 and the lower half partition plate second recessed portion 322 are formed.

In the upper half assembling step S60 of the second embodiment, before the upper half partition plate 31A is disposed on the inner peripheral side of the upper half casing 41A, the upper half vertical position provisional defining portion 9 is fixed to the upper half partition plate third recessed portion 313. Thereafter, the upper half partition plate 31A is disposed on the inner peripheral side of the upper half casing 41A such that the upper half vertical position provisional defining portion 9 is positioned at the upper half casing third recessed portion 413. After the upper half partition plate 31A is disposed on the inner peripheral side of the upper half casing 41A, the upper half vertical position defining portion 5A is attached to the upper half casing 41A. Specifically, the upper half assembling step S60 of the second embodiment includes: an upper half casing disposition step S610; an upper half partition plate disposition step S620; an upper half horizontal position defining step S630; and an upper half vertical position defining step S640.

In the upper half assembling step S60 of the second embodiment, the upper half vertical position defining step S640 is different from that of the first embodiment. In the upper half assembling step S60, similarly to the first embodiment, the upper half vertical position defining step S640 is performed after the horizontal position defining step is performed. In the upper half vertical position defining step S640 of the second embodiment, the upper half vertical third abutment portion 91 is fitted into the upper half partition plate third recessed portion 313 and is fixed to the upper half partition plate third recessed portion 313. Thereafter, the upper half partition plate 31A is disposed on the inner peripheral side of the upper half casing 41A such that the upper half vertical third abutment portion 91 is fitted into the upper half casing third recessed portion 413. The upper half casing 41A is lifted in the vertical direction Dv from this state, and the upper half vertical third abutment side surface 91*b* is cut off such that the upper half partition plate division surface 310X and the upper half casing division surface 410X are disposed on the same horizontal surface. Accordingly, the position of the upper half partition plate 31A in the vertical direction Dv with respect to the upper half casing 41A is adjusted. In this case, the upper half vertical third abutment side surface 91*b* is cut off such that the upper half partition plate division surface 310X and the upper half casing division surface 410X are disposed on the same horizontal surface and the upper half partition plate first flat surface 315*a* is positioned to be farther from the upper half casing division surface 410X than the upper half casing first flat surface 415*a*. After the upper half vertical third abutment side surface 91*b* is cut off, the upper half abutment surface 511A abuts against the upper half casing first flat surface 415*a* to fix the upper half abutment member 51A is fixed. In this case, the upper half abutment surface 511A is slightly separated from the upper half partition plate first flat surface 315*a*.

In the lower half assembling step S70 of the second embodiment, before the lower half partition plate 32A is disposed on the inner peripheral side of the lower half casing 42A, the lower half vertical second abutment portion 61A is fixed to the lower half partition plate second recessed portion 322. Thereafter, the lower half partition plate 32A is disposed on the inner peripheral side of the lower half casing 42A such that the lower half vertical second abutment portion 61A is positioned on the lower half casing second recessed portion 422. Specifically, the lower half assembling step S70 of the second embodiment includes: a lower half casing disposition step S710; a lower half partition plate disposition step S720; a lower half horizontal position defining step S730; and a lower half vertical position defining step S740.

In the lower half assembling step S70 of the second embodiment, the lower half vertical position defining step S740 is different from that of the first embodiment. In the lower half vertical position defining step S740 of the second embodiment, the lower half vertical second abutment portion 61A is fitted to the lower half partition plate second recessed portion 322 and is fixed to the lower half partition plate second recessed portion 322. Thereafter, the lower half partition plate 32A is disposed on the inner peripheral side of the lower half casing 42A such that the lower half vertical second abutment portion 61A is fitted into the lower half casing second recessed portion 422. The lower half partition plate 32A is lifted in the vertical direction Dv from this state, and the lower half vertical second abutment side surface 616 is cut off such that the lower half partition plate division surface 320X and the lower half casing division surface 420X are disposed on the same horizontal surface. Accordingly, the position of the lower half partition plate 32A in the vertical direction Dv with respect to the lower half casing 42A is adjusted.

In the final assembling step S80, the upper half casing division surface 410X abuts against the lower half casing division surface 420X to install the upper half assembly 11 on the lower half assembly 12. By inverting the upper half assembly 11 such that the upper half partition plate division surface 310X faces downward in the vertical direction Dv, the upper half partition plate body 310A is deviated downward in the vertical direction Dv with respect to the upper half casing body 410A. Accordingly, the upper half abutment surface 511A of the upper half abutment member 51A fixed to the upper half casing 41A and the upper half partition plate first flat surface 315*a* abut against each other. As a result, the upper half partition plate first flat surface 315*a* protrudes with respect to the upper half casing first flat surface 415*a*. In this state, the upper half partition plate division surface 310X comes into contact with the lower half partition plate division surface 320X and abuts against the lower half partition plate division surface 320X, and thus, the upper half partition plate division surface 310X which further protrudes than the upper half casing division surface

410X is pushed by the lower half partition plate division surface 320X. As a result, the upper half partition plate 31A moves with respect to the upper half casing 41A in a state where the upper half partition plate division surface 310X abuts against the lower half partition plate division surface 320X. Accordingly, the steam turbine 1 is formed in a state where the upper half casing division surface 410X abuts against the lower half casing division surface 420X and the upper half partition plate division surface 310X abuts against the lower half partition plate division surface 320X.

Similarly to the first embodiment, in the above-described second embodiment, the positions of the upper half casing division surface 410X and the upper half partition plate division surface 310X can be finally defined in a state where the upper half casing 41A and the upper half partition plate 31A are assembled together. In addition, by only placing the upper half assembly 11 on the lower half assembly 12, the lower half partition plate division surface 320X and the upper half partition plate division surface 310X can come into contact with the lower half partition plate division surface 320X and the upper half partition plate division surface 310X at high accuracy. Accordingly, it is possible to suppress occurrence of the gap between the upper half assembly 11 and the lower half assembly 12 while decreasing the amount of adjustment needed in positioning.

Hereinbefore, the embodiments of the present invention are described with reference to the drawings. However, configurations and a combination thereof in each embodiment are examples, and addition, omission, replacement, and other modifications of the configurations can be made within a scope which does not depart from the gist of the present invention. In addition, the present invention is not limited to the embodiments and is limited by only claims.

INDUSTRIAL APPLICABILITY

The steam turbine assembling method, the steam turbine, and the upper half assembly described above make it possible to suppress the occurrence of a gap between the upper half assembly 11 and the lower half assembly 12 while decreasing the amount of adjustment needed in positioning.

DESCRIPTION OF REFERENCE NUMERALS

1: steam turbine
Ar: axis
Da: axial direction
Dr: radial direction
Dc: circumferential direction
Dv: vertical direction
Dh: horizontal direction
2: rotor
21: rotor shaft
22: rotor blade
3, 3A: partition plate
30: stator blade
31, 31A: upper half partition plate
310, 310A: upper half partition plate body
311, 315: upper half partition plate first recessed portion
311*a*, 315*a*: upper half partition plate first flat surface
311*b*, 315*b*: upper half partition plate first curved surface
312: upper half partition plate second recessed portion
312*a*: upper half partition plate second flat surface
312*b*: upper half partition plate second curved surface
31X, 310X: upper half partition plate division surface
32, 32A: lower half partition plate
320, 320A: lower half partition plate body
321: lower half partition plate first recessed portion
321*a*: lower half partition plate first flat surface
321*b*: lower half partition plate first curved surface
32X, 320X: lower half partition plate division surface
4, 4A: casing
41, 41A: upper half casing
410, 410A: upper half casing body
411, 415: upper half casing first recessed portion
411*a*, 415*a*: upper half casing first flat surface
411*b*, 415*b*: upper half casing first curved surface
412: upper half casing second recessed portion
412*a*: upper half casing second flat surface
412*b*: upper half casing second curved surface
41X, 410X: upper half casing division surface
42, 42A: lower half casing
420: lower half casing body
421: lower half casing first recessed portion
421*a*: lower half casing first flat surface
421*b*: lower half casing first curved surface
42X, 420X: lower half casing division surface
5, 5A: upper half vertical position defining portion
51, 51A: upper half abutment member
511, 511A: upper half abutment surface
512, 512A: upper half separation surface
513, 513A: upper half connection side surface
52, 52A: upper half first fixing member
53: upper half second fixing member
54: upper half abutment member first through-hole
55: upper half abutment member second through-hole
6, 6A: lower half vertical position defining portion
61: lower half abutment member
611: lower half abutment surface
612: lower half separation surface
613: lower half connection side surface
62: lower half first fixing member
63: lower half abutment member first through-hole
61A: lower half vertical second abutment portion
615: lower half vertical second abutment flat surface
616: lower half vertical second abutment side surface
7: upper half horizontal position defining portion
71: upper half horizontal first abutment portion
71*a*: upper half horizontal first abutment flat surface
71*b*: upper half horizontal first abutment curved surface
72: upper half horizontal second abutment portion
72*a*: upper half horizontal second abutment flat surface
72*b*: upper half horizontal second abutment curved surface
73: upper half horizontal fixing member
8: lower half horizontal position defining portion
81: lower half horizontal first abutment portion
81*a*: lower half horizontal first abutment flat surface
81*b*: lower half horizontal first abutment curved surface
82: lower half horizontal second abutment portion
82*a*: lower half horizontal second abutment flat surface
82*b*: lower half horizontal second abutment curved surface
83: lower half horizontal fixing member
11: upper half assembly
12: lower half assembly
S: accommodation space
S1, S10: steam turbine assembling method
S2, S20: upper half casing preparation step
S21: upper half casing body forming step
S22, S220: upper half casing recessed portion forming step
S3, S30: upper half partition plate preparation step
S31: upper half partition plate body forming step S32, S320: upper half partition plate recessed portion forming step S4, S40: lower half casing preparation step S41: lower half casing body forming step S42, S420: lower half casing recessed portion forming step S5, S50: lower half partition plate preparation step S51: lower half partition plate body forming step S52, S520: lower half partition plate recessed portion forming step S6, S60: upper half assembling step S61: upper half casing disposition step S62: upper half partition plate disposition step S63, S630: upper half horizontal position defining step S64, S640: upper half vertical position defining step S7, S70: lower half assembling step S71: lower half casing disposition step S72: lower half partition plate disposition step S73, S730: lower half horizontal position defining step S74, S740: lower half vertical position defining step S8, S80: final assembling step 313: upper half partition plate third recessed portion 313*a*: upper half partition plate third flat surface 313*b*: upper half partition plate third side surface 322: lower half partition plate second recessed portion 322*a*: lower half partition plate second flat surface 322*b*: lower half partition plate second side surface 413: upper half casing third recessed portion 413*a*: upper half casing third flat surface 413*b*: upper half casing third side surface 422: lower half casing second recessed portion 422*a*: lower half casing second flat surface 422*b*: lower half casing second side surface 9: upper half vertical position provisional defining portion 9*a*: upper half vertical third abutment flat surface 91*b*: upper half vertical third abutment side surface

The invention claimed is:

1. A steam turbine assembling method comprising:

an upper half casing preparation step of preparing an upper half casing that extends in a circumferential direction of a rotor rotatable about an axis and that comprises upper half casing division surfaces on both ends of the upper half casing in the circumferential direction, the upper half casing division surfaces being horizontal surfaces facing downward in a vertical direction;

a lower half casing preparation step of preparing a lower half casing that extends in the circumferential direction and that comprises lower half casing division surfaces on both ends of the lower half casing in the circumferential direction, the lower half casing division surfaces being configured to abut against the upper half casing division surfaces;

an upper half partition plate preparation step of preparing an upper half partition plate that extends in the circumferential direction to be disposed on an inner peripheral side of the upper half casing and that comprises upper half partition plate division surfaces on both ends of the upper half partition plate in the circumferential direction, the upper half partition plate division surfaces being horizontal surfaces facing downward in the vertical direction;

a lower half partition plate preparation step of preparing a lower half partition plate that extends in the circumferential direction to be disposed on an inner peripheral side of the lower half casing and that comprises lower half partition plate division surfaces on both ends of the lower half partition plate in the circumferential direction, the lower half partition plate division surfaces being configured to abut against the upper half partition plate division surfaces;

an upper half assembling step of forming an upper half assembly by attaching, after disposing the upper half partition plate on the inner peripheral side of the upper half casing, an upper half position defining portion to at least one of the upper half casing or the upper half partition plate, wherein the upper half position defining portion causes the upper half casing and the upper half partition plate to be movable relative to each other such that the upper half partition plate division surfaces protrude with respect to the upper half casing division surfaces in the vertical direction;

a lower half assembling step of forming a lower half assembly by disposing the lower half partition plate on the inner peripheral side of the lower half casing; and an assembling step of installing the upper half assembly on the lower half assembly by abutting the upper half casing division surfaces against the lower half casing division surfaces in a state where the upper half partition plate division surfaces protrude further downward in the vertical direction than the upper half casing division surfaces, wherein the upper half position defining portion regulates movement of the upper half partition plate lowered by its own weight in the state where the upper half partition plate division surfaces protrude further downward in the vertical direction than the upper half casing division surfaces, wherein the upper half casing further comprises:

an upper half casing recessed portion that is recessed upward in the vertical direction on an inner peripheral side of the upper half casing division surfaces and that comprises an upper half casing recess surface that faces a direction comprising the vertical direction, wherein the upper half partition plate further comprises an upper half partition plate recessed portion that is recessed upward in the vertical direction on an outer peripheral side of the upper half partition plate division surfaces, wherein the upper half partition plate recessed portion comprises an upper half partition plate recess surface that faces the direction comprising the vertical direction, and wherein the upper half partition plate recessed portion forms an accommodation space that communicates with the upper half casing recessed portion when disposed on the inner peripheral side of the upper half casing.

2. The steam turbine assembling method according to claim 1, wherein the upper half assembling step comprises:

an upper half casing disposition step of disposing the upper half casing in a state where the upper half casing division surfaces face upward in the vertical direction;

an upper half partition plate disposition step of disposing the upper half partition plate on the inner peripheral side of the upper half casing in a state where the upper half partition plate division surfaces face upward in the vertical direction; and an upper half vertical position defining step of defining, after the upper half partition plate is disposed, positions of the upper half casing and the upper half partition plate in the vertical direction, wherein the upper half vertical position defining step comprises:

providing, as the upper half position defining portion in the accommodation space, an upper half abutment member having an upper half abutment surface configured to abut against the upper half casing recess surface and the upper half partition plate recess surface, and fixing the upper half abutment member in a state where the upper half abutment surface abuts against at least one of the upper half casing recess surface and the upper half partition plate recess surface and in a state where the upper half abutment surface is movable in the vertical direction relative to the other of the upper half casing recess surface and the upper half partition plate recess surface.

3. The steam turbine assembling method according to claim 2, wherein the lower half assembling step comprises fixing a lower half abutment member having a lower half abutment surface which is a horizontal surface to at least one of the lower half casing and the lower half partition plate in a state where the lower half abutment surface abuts against the lower half casing division surface and the lower half partition plate division surface.

4. The steam turbine assembling method according to claim 2, wherein in the upper half casing preparation step, the upper half casing recess surface is formed to be parallel to the upper half casing division surface, and wherein in the upper half partition plate preparation step, the upper half partition plate recess surface is formed to be parallel to the upper half partition plate division surface.

5. The steam turbine assembling method according to claim 4, wherein the upper half vertical position defining step further comprises causing the upper half abutment surface to abut against the upper half casing recess surface and the upper half partition plate recess surface to fix the upper half abutment member.

6. The steam turbine assembling method according to claim 5, wherein the lower half assembling step comprises fixing a lower half abutment member having a lower half abutment surface which is a horizontal surface to at least one of the lower half casing and the lower half partition plate in a state where the lower half abutment surface abuts against the lower half casing division surface and the lower half partition plate division surface.

7. The steam turbine assembling method according to claim 4, wherein the lower half assembling step comprises fixing a lower half abutment member having a lower half abutment surface which is a horizontal surface to at least one of the lower half casing and the lower half partition plate in a state where the lower half abutment surface abuts against the lower half casing division surface and the lower half partition plate division surface.

8. The steam turbine assembling method according to claim 2, wherein the upper half vertical position defining step further comprises causing the upper half abutment surface to abut against the upper half casing recess surface and the upper half partition plate recess surface to fix the upper half abutment member.

9. The steam turbine assembling method according to claim 8, wherein the lower half assembling step comprises fixing a lower half abutment member having a lower half abutment surface which is a horizontal surface to at least one of the lower half casing and the lower half partition plate in a state where the lower half abutment surface abuts against the lower half casing division surface and the lower half partition plate division surface.

10. The steam turbine assembling method according to claim 1, wherein the lower half assembling step comprises fixing a lower half abutment member having a lower half abutment surface which is a horizontal surface to at least one of the lower half casing and the lower half partition plate in a state where the lower half abutment surface abuts against the lower half casing division surface and the lower half partition plate division surface.

* * * * *